US008636603B2

(12) United States Patent
Rauchholz

(10) Patent No.: US 8,636,603 B2
(45) Date of Patent: Jan. 28, 2014

(54) AUTOMATIC CLUB SETTING AND BALL FLIGHT OPTIMIZATION

(75) Inventor: William F. Rauchholz, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 13/349,890

(22) Filed: Jan. 13, 2012

(65) Prior Publication Data

US 2013/0184095 A1 Jul. 18, 2013

(51) Int. Cl.
*A63B 69/36* (2006.01)

(52) U.S. Cl.
USPC ..... 473/221; 473/131; 473/212; 473/213; 473/215; 473/217; 473/218; 473/219; 473/233; 473/407; 473/409; 463/7; 463/30; 463/43

(58) Field of Classification Search
USPC ..... 473/131, 212–219, 407–409, 342, 346; 463/7, 30, 39–43
See application file for complete search history.

(56) References Cited

U.S. PATENT DOCUMENTS

| | | | | |
|---|---|---|---|---|
| 3,931,363 | A * | 1/1976 | Giolito et al. | 558/150 |
| 7,166,041 | B2 * | 1/2007 | Evans | 473/334 |
| 8,342,978 | B2 * | 1/2013 | Tamura | 473/212 |
| 2004/0067797 | A1 * | 4/2004 | Knecht | 473/223 |
| 2005/0054457 | A1 * | 3/2005 | Eyestone et al. | 473/221 |
| 2006/0240908 | A1 * | 10/2006 | Adams et al. | 473/334 |
| 2007/0135225 | A1 * | 6/2007 | Nieminen et al. | 473/212 |
| 2009/0203462 | A1 | 8/2009 | Stites et al. | |
| 2011/0207552 | A1 * | 8/2011 | Finn et al. | 473/342 |
| 2011/0230273 | A1 | 9/2011 | Niegowski et al. | |

OTHER PUBLICATIONS

International Search Report and Written Opinion received in corresponding International Patent Application No. PCT/US2013/021466 mailed Aug. 16, 2013.

* cited by examiner

*Primary Examiner* — Sunit Pandya
(74) *Attorney, Agent, or Firm* — Banner & Witcoff, Ltd.

(57) ABSTRACT

Systems, methods, and computer readable media for changing and controlling settings for adjustable golf clubs are described. Such setting adjustment systems may alter one or more of: lie angle, loft angle, face angle, shaft stiffness, shaft kickpoint location, weighting, weight positioning, face flexibility, maximum face flex location, etc. These systems and methods may use various types of information to determine the appropriate settings, such as: ball launch monitor data, swing path data, weather input data, course condition input data for a location of play, course design input data for a location of play, daily course layout input data for a location and a time of play, golfer past performance data (e.g., recent past performance, past performances at the location of play, past performance during an ongoing round of golf (i.e., on earlier played holes), etc.), current adjustable club setting information, and information indicating specific holes to be played.

39 Claims, 20 Drawing Sheets

Computer
Input Data
1310
1302
1302F
1300
1304

100
Computer
Input Data
1310
1300
1302
1302F
C
1306
1306
1304

AUTOMATIC CLUB SETTING AND BALL FLIGHT OPTIMIZATION

FIELD OF THE INVENTION

The invention relates generally to adjustable golf equipment systems, methods, and computer-readable media and to systems and methods for optimizing golf equipment parameters (e.g., club or ball specifications) to a specific user and/or for a specific round of golf.

BACKGROUND

Beginning about 2008, golf's rulemaking authorities changed the Rules of Golf to allow an increased number of options for making golf clubs "adjustable." This change in the Rules of Golf has led to a variety of new golf club constructions, particularly for drivers and fairway woods. As some examples, many golf clubs now are designed with mechanisms that allow the head and shaft to be easily disconnected and reconnected, optionally, to exchange shafts or heads with respect to one another, to change various angles (e.g., face angle, loft angle, lie angle, etc.), etc. In some commercially available structures, releasable golf club head and shaft connection technology is coupled with other customization options, such as the ability to engage one or more different weights with weight ports or other weight receiving elements on the club head to adjust the weighting characteristics of the club. Technology also is available to allow for variations in the physical positioning of weights on a golf club head. In some known and commercially available golf clubs, the overall length of the shaft also may be adjusted.

These customization and adjustability options for golf club settings can provide a number of possible settings and/or orientations of parts for a single golf club. But these customization and adjustability options can be somewhat daunting for a player, who must work to determine which setting(s) is (are) best for their game. Moreover, determining the best settings can be a time consuming endeavor, and many casual golfers do not have the desire or practice time available to properly test and determine the best settings for their game. Therefore, many golfers with adjustable golf club technology will find particular settings or other arrangement of parts that they like and then forever keep their club fixed with those settings and arrangements. Such users are not necessarily getting the most out of the customizable and adjustable golf club technology that they have purchased.

Additionally, club and/or ball fitting, even on an individual level, is not necessarily a "one-size-fits-all" situation. A golfer's swing may vary on any given day (e.g., due to swing changes they are working on, due to injury or soreness, etc.), thus making the adjustable golf club settings, golf club selections, or golf ball selections for one round not necessarily optimal for the golfer in another round. Also, the optimal adjustable golf club settings or equipment selections for a given round of golf may change for an individual golfer depending on various factors, such as the weather, the golf course design, the daily golf course set up, the golf course condition, and the like. Most golfers are not well versed with information relating to these numerous details to enable then to reliably select the best adjustable golf club settings and/or golf equipment selections (e.g., clubs or balls) that can take this type of additional information into account.

Accordingly, systems and methods that would help golfers determine which adjustable golf club settings and/or other equipment options are best for their game, optionally at any give time, for any given round, and/or at any desired golf course, would be a welcome advance in the art.

SUMMARY

The following presents a general summary of some aspects of the present invention in order to provide a basic understanding of this invention. This summary is not intended as an extensive overview of the invention. It is not intended to identify key or critical elements of the invention or to delineate the scope of the invention. The following summary merely presents some concepts of the invention in a general form as a prelude to the more detailed description provided below.

In general, aspects of this invention relate to systems, methods, and computer readable media used to change and control settings for adjustable golf clubs and/or used to select optimal golf equipment options. Such setting adjustment systems may alter one or more of: lie angle, loft angle, face angle, shaft stiffness, shaft kickpoint location, weighting, weight positioning, face flexibility, maximum face flex location, etc. Such equipment options may include club selection, club set configuration, club shaft selection, ball model selection, etc.

Systems, methods, and computer readable media according to at least some aspects of the invention may use various types of data, information, and input to determine the appropriate settings or other options, including, for example, one or more of: ball launch monitor data, swing path data, weather input data, course condition input data for a location of play, course design input data for a location of play, daily course layout input data for a location and a time of play, golfer past performance data (e.g., recent past performance, past performances at the location of play, past performance during an ongoing round of golf (i.e., on earlier played holes), etc.), current adjustable club setting information, shaft flex information, ball model information, and information indicating specific holes to be played.

Such systems, methods, and computer readable media may be used, for example, when purchasing or testing a new product, before play begins (optionally at the golf course's practice tee on the day of play), during the course of play (e.g., at the start of one or more individual holes on the golf course), and/or even during the course of an individual golf swing.

These and other additional aspects of this invention will become more evident from the detailed description of the invention provided below.

BRIEF DESCRIPTION OF THE DRAWINGS

A more complete understanding of the present invention and certain advantages thereof may be acquired by referring to the following detailed description in consideration with the accompanying drawings, in which the same reference numbers indicate the same or similar features, and wherein.

DETAILED DESCRIPTION

Figure 1A:
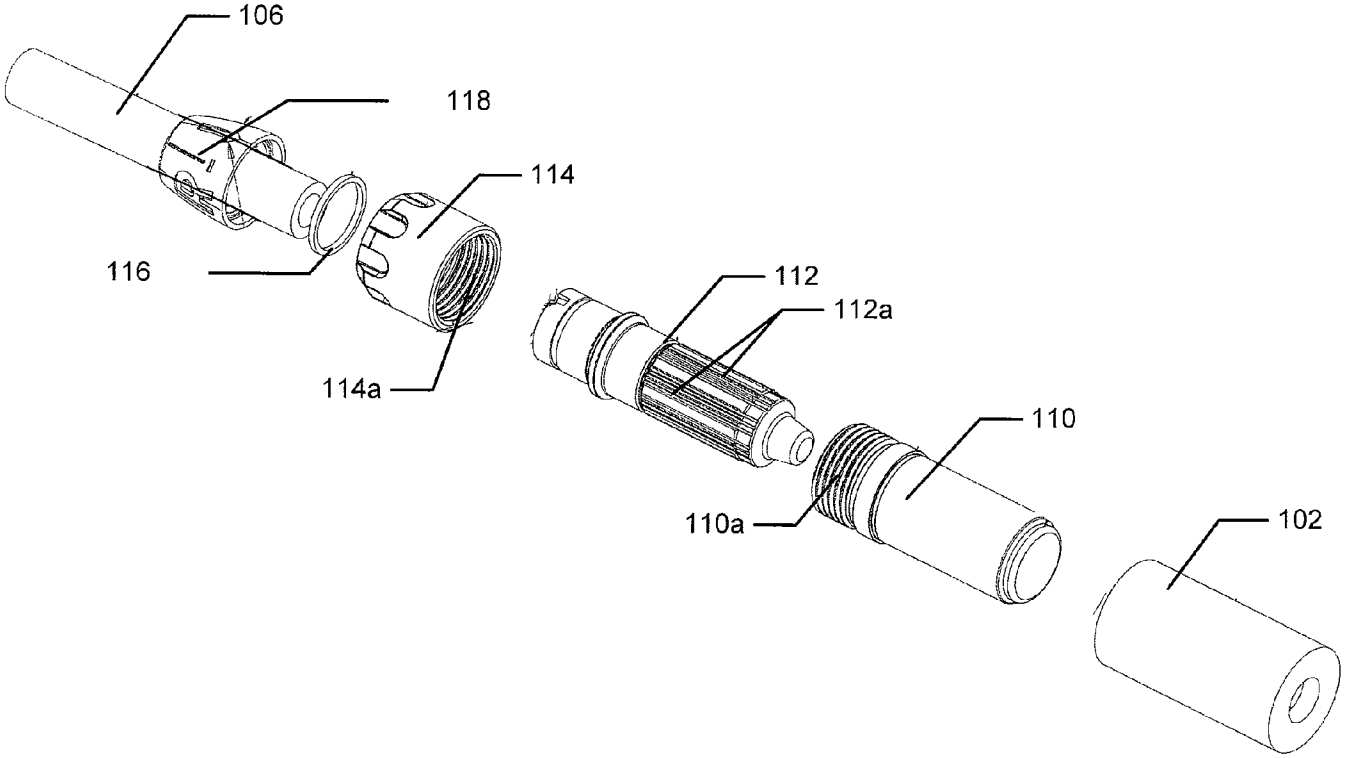
Fig. 1A (Prior Art)
FIGS. 1A through 6 illustrate example features of various adjustable golf clubs that are or have been available on the market and that may be used in accordance with at least some aspects of this invention.

A general description of aspects of the invention followed by a more detailed description of specific examples of the invention follows.

A. General Description of Various Aspects of the Invention

1. Basic Adjustable Golf Club Setting and/or Golf Equipment Selection Aspects and Features At least some aspects of this invention relate to systems for automatically providing golf club setting adjustment information and/or golf equipment selection information customized for a specific player. Such systems may include, for example, one or more of the following: (a) a computer input system for receiving golf ball launch data relating to one or more golf swings by a golfer using a golf club; (b) a computer processing system for generating adjustable golf club setting data and/or golf equipment selection data at least in part based on the golf ball launch data; (c) a computer output system for outputting data indicative of adjustable golf club setting information for the golf club and/or golf equipment selection information based on the data generated by the computer processing system; (d) a golf ball launch monitoring system in communication with the computer input system for generating the golf ball launch data; (e) a transmission system for transmitting the golf ball launch data from the golf ball launch monitoring system to the computer input system; and/or (f) an output system operatively coupled with the computer output system for outputting the adjustable golf club setting information and/or golf equipment selection information in a user perceptible manner (e.g., such as via an audio display, a video display, a textual or alpha-numeric display, a cellular telephone display screen, a golf GPS device display screen, etc.). When recommending a golf club set for use by the golfer, systems and methods according to at least some examples of this invention may recommend for at least two clubs from the golfer's personal inventory to be used by the golfer in a future round of golf, and in some examples, at least 8 clubs, at least 13 clubs, or even all 14 clubs.

The data indicative of the adjustable golf club setting information may include any desired type of adjustable club setting information. As some more specific examples, the adjustable golf club setting information may include one or more of:

(a) information indicating a suggested lie angle setting for the golf club;

(b) information indicating a suggested loft angle setting for the golf club;

(c) information indicating a suggested face angle setting for the golf club;

(d) information indicating suggested weighting parameters for the golf club, e.g., suggested weighting for one or more specific weight locations on the golf club head or shaft, suggested weight positions for one or more weights to be engaged with the golf club head or shaft, suggested amounts of weight to be engaged at one or more locations on a golf club head or shaft, suggested weight positioning for one or more weights along a rail provided with the golf club head, etc.;

(e) information indicating suggested relative positioning of a golf club head with respect to a golf club shaft to be engaged with the golf club head;

(f) information indicating suggested orientation of one or more adjustable hosel rings with respect to a golf club head or shaft;

(g) information indicating one or more suggested specific spacers or specific spacer sizes to be engaged with a golf club head or shaft;

(h) information indicating a suggested orientation of one or more adjustable sole members with respect to a golf club head with which it is to be engaged;

(i) information indicating suggested shaft stiffness adjustment information;

(j) information indicating suggested shaft kickpoint location adjustment information; and/or (k) face flexibility information.

Optionally, if desired, systems according to at least some examples of this invention also may receive computer input indicating current club setting input data, and the computer processing system will generate the adjustable golf club setting data at least in part based on the current club setting input data. Also, if desired, systems of this type could be provided directly at a golf course to be played, e.g., on a driving range located at or near the course, optionally right on the tee of that driving range.

The data indicative of golf equipment selection information may include any desired golf equipment specification or parameter. As some more specific examples, golf equipment selection information may include: selecting one or more shafts from a plurality of shafts in the equipment inventory available to the golfer (e.g., higher flex v. stiffer flex, different kickpoint locations, etc.); selecting one or more club heads from a plurality of club heads in the equipment inventory available to the golfer (a 9° driver head v. a 10° driver head); selecting one or more clubs (e.g., a fourteen club set, a driver, a putter, a thirteen club set (all clubs except putter or driver), a set of wedges, a set of hybrids and/or fairway woods, etc.) from a plurality of clubs in the equipment inventory available to the golfer (e.g., replace a high lofted wedge with another hybrid or fairway wood or vice versa, etc.); selecting one or more ball models for use in the round (e.g., a higher spin ball v. a lower spin ball); etc. The "equipment inventory available to the golfer" may represent the overall equipment already owned by the golfer or otherwise available for his/her use (e.g., systems and methods according to this invention may help the golfer select the best 14 (or fewer) clubs for a given round of golf based on all of the clubs owned by the golfer and/or otherwise available for his/her use).

Additional potential features of this aspect of the invention relate to methods of operating and/or using the systems described above, e.g., to provide adjustable golf club setting information and/or golf equipment selection information customized to a specific golfer. Such methods may include at least some steps performed by a computer (such as receiving input data, transmitting output data, collecting sensor data, storing data, processing data, generating output, displaying output, etc.).

Still additional aspects of this invention may relate to non-transitory computer readable media that include computer executable instructions stored thereon for operating the hardware systems and/or performing the methods described above (and described in more detail below). Such non-transitory computer readable media may include instructions stored thereon for performing the following steps: (a) receiving golf ball launch data relating to one or more golf swings by a golfer using a golf club; (b) generating adjustable golf club setting data and/or golf equipment selection data at least in part based on the golf ball launch data; (c) outputting data indicative of adjustable golf club setting information for the golf club (e.g., of the types described above) and/or golf equipment selection information based on the data generated by the computer processing system; (d) generating the golf ball launch data; (e) storing the golf ball launch data in a computer memory; and/or (f) outputting the adjustable golf club setting information and/or golf equipment selection information in a user perceptible manner (e.g., in any of the various manners described above, using any of the various devices described above). The computer readable media may constitute any desired type of computer memory or hardware.

2. Providing Suggested Adjustable Golf Club Setting Information and/or Golf Equipment Selection Information Utilizing Additional Input Additional aspects of this invention relate to other types of systems for providing golf club setting adjustment information and/or golf equipment selection information that seek to tailor the setting adjustments and/or equipment recommendations for play at a specific course, at a specific time, and/or based on recent performances by the golfer. Such systems may include, for example, one or more of: (a) a computer input system for receiving input data selected from the group consisting of: weather input data relating to a location of a golf course to be played, course condition input data relating to the location (e.g., the golf course) to be played, course design input data relating to the location to be played, daily course layout input data for the location to be played, golfer past performance input data, and input data relating to golfer's past performance at the location to be played; (b) a computer processing system for generating adjustable golf club setting data for a golf club and/or golf equipment selection data at least in part based on the input data; (c) a computer output system for outputting data indicative of adjustable golf club setting information and/or golf equipment selection information for the golfer based on the data generated by the computer processing system; and/or (d) an output system operatively coupled or in communication with the computer output system for outputting the adjustable golf club setting information and/or golf equipment selection information in a user perceptible manner, (e.g., an audio display system, a video display system, a computer display screen, etc.). Optionally, if desired, systems according to at least some examples of this invention also may receive computer input indicating current club setting input data, and the computer processing system will generate the adjustable golf club setting data at least in part based on the current club setting input data. When the input data includes golfer past performance data, that past performance data may include data indicating the adjustable golf club settings used by the golfer during that past performance. When recommending a golf club set for use by the golfer, systems and methods according to at least some examples of this aspect of the invention may recommend for at least two clubs from the golfer's personal inventory to be used by the golfer in a future round of golf, and in some examples, at least 8 clubs, at least 13 clubs, or even all 14 clubs.

The weather input data used by systems and methods according to at least some examples of this aspect of the invention may include, for example, one or more of: current weather information for a location of play, predicted weather information for the location of play over a time of play, current wind speed information for the location of play, predicted wind speed information for the location of play over the time of play, current wind direction information for the location of play, predicted wind direction information for the location of play over the time of play, prevailing wind direction information for the location of play, prevailing wind direction information for the location of play over the time of play, average wind speed information for the location of play, chance of precipitation for the location of play over the time of play, and a predicted precipitation amount for the location of play over the time of play.

The course condition input data for the location of play used by systems and methods according to at least some examples of this aspect of the invention may include, for example, one or more of: recent past weather information, fairway grass height or thickness information, rough grass height or thickness information, fairway hardness information, rough hardness information, recent fairway watering information, recent rough watering information, fairway speed information, and rough speed information. This type of information may be generated by or make use of, for example, ball movement distance within the grass observed after a standard propulsion event (e.g., in a manner akin to green speed measurements made using a "Stimpmeter" or other green speed measuring device).

The course design input data for the location of play used by systems and methods according to at least some examples of this aspect of the invention may include, for example, one or more of: a number or percentage of holes having a dogleg left design, a number or percentage of holes having a dogleg right design, a number or percentage of holes having a straight design, a number or percentage of holes having a preferred right-to-left ball flight direction, a number or percentage of holes having a preferred left-to-right ball flight direction, locations of hazards, locations of out of bounds, hill location information, hill slope information, fairway location or boundary information, a number of forced carries, a location of forced carries, and ball flight distance required to clear any forced carries.

The daily course layout input data for the location of play used by systems and methods according to at least some examples of this aspect of the invention may include, for example, one or more of: tee marker position information for plural individual holes, pin placement information for plural individual holes, hole lengths for plural individual holes, distances to hazards or out of bounds areas for plural individual holes, and distances to clear hazards or out of bounds areas for plural individual holes.

The golfer's past performance input data used by systems and methods according to at least some examples of this aspect of the invention may include, for example, one or more of: ball flight information (or ball launch data) for the golfer during one or more previous rounds, number of out of bounds shots hit left by the golfer during one or more previous rounds, number of out of bounds shots hit right by the golfer during one or more previous rounds, number of left side located hazards hit by the golfer during one or more previous rounds, number of right side located hazards hit by the golfer during one or more previous rounds, number or percentage of fairways missed left by the golfer during one or more previous rounds, number or percentage of fairways missed right by the golfer during one or more previous rounds, number or percentage of greens missed left by the golfer during one or more previous rounds, number or percentage of greens missed right by the golfer during one or more previous rounds, number or percentage of fairways missed short by the golfer during one or more previous rounds, number or percentage of fairways missed long by the golfer during one or more previous rounds, number or percentage of greens missed short by the golfer during one or more previous rounds, and number or percentage of greens missed long by the golfer during one or more previous rounds. If desired, this input data may relate to just recent rounds, rounds within a specific time frame, rounds (optionally recent rounds) on the specific course to be played, rounds played with certain equipment, etc.

Optionally, if desired, systems according to at least some examples of this invention also may receive computer input indicating specific holes to be played by the golfer on the golf course, and the computer processing system will then generate the adjustable golf club setting data and/or golf equipment selection data at least in part based on the input data indicating the specific holes to be played. If desired, systems of this type could be provided directly at the golf course to be played, e.g., on a driving range at or near the course, even right on the tee of the driving range.

Additional potential features of this aspect of this invention relate to methods of operating and/or using the equipment described above, e.g., to provide golf swing, golf equipment selection, and/or adjustable golf club setting information. Such methods may include at least some steps performed by a computer (such as receiving input data, transmitting output data, collecting sensor data, storing data, processing data, generating output, displaying output, etc.). Still additional aspects of this invention may relate to computer readable media that include computer executable instructions stored thereon for operating the hardware systems and/or performing the methods described above (and described in more detail below).

3. Systems for Automatically Adjusting One or More Settings of an Adjustable Golf Club Still additional aspects of this invention relate to adjustable golf club systems that include one or more of: (a) an input system for receiving golf ball launch data relating to one or more golf swings by a golfer using a golf club; (b) a computer processing system for generating adjustable golf club setting data at least in part based on the golf ball launch data; (c) a golf club setting adjustment system engaged with or temporarily engagable with the golf club; and (d) a transmission system (wired or wireless) for transmitting adjustable golf club setting information to the golf club setting adjustment system, wherein the adjustable golf club setting information is the adjustable golf club setting data or data derived from the adjustable golf club setting data. The golf club engages with the golf club setting adjustment system, and this system automatically alters one or more adjustable settings of the golf club based on the determined adjustable golf club setting information.

Some or all of such systems, including the golf club setting adjustment mechanism, may be at least partially integrated into the golf club structure and/or may be provided as one or more devices that are separate from (and temporarily engagable with) the golf club. The setting adjustment system may alter one or more of: lie angle, loft angle, face angle, shaft stiffness, shaft kickpoint location, weighting, weight positioning, face flexibility, maximum face flex location, etc. When at least partially separate from the golf club, the separate component(s) may be provided at a golf club adjustment station that includes structure for engaging the golf club. This golf club adjustment station may be provided at a retail setting, at the practice tee on individual golf courses, and/or even on one or more individual holes at the golf course (e.g., at one or more tees).

Systems and methods according to this aspect of the invention also may use any of the input systems and/or input data described above, including ball launch monitor data, weather input data, course condition input data for a location of play, course design input data for a location of play, daily course layout input data for a location and a time of play, golfer past performance data (e.g., recent past performance, past performances at the location of play, past performance during an ongoing round of golf (i.e., on earlier played holes), etc.), current adjustable club setting information, and/or information indicating specific holes to be played.

Additional potential features of this aspect of this invention relate to methods of operating and/or using the equipment described above, e.g., to provide golf swing information and/or adjustable golf club setting information. Such methods may include at least some steps performed by a computer (such as receiving input data, transmitting output data, collecting sensor data, storing data, processing data, generating output, displaying output, etc.). Still additional aspects of this invention may relate to computer readable media that include computer executable instructions stored thereon for operating the hardware systems and/or performing the methods described above (and described in more detail below).

4. Systems for Automatically Adjusting One or More Settings of an Adjustable Golf Club "On the Fly"

Additional aspects of this invention relate to systems for adjusting golf club settings "on the fly," i.e., during the course of a swing. Such systems may include a golf club, comprising one or more of: (a) a golf club head; (b) a shaft engaged with the golf club head; (c) a grip member engaged with the shaft; (d) a sensor system (e.g., one or more accelerometers or gyrometers) engaged with at least one of the golf club head, the shaft, or the grip member, wherein the sensor system produces input data regarding the swing path of the golf club and/or the golf club orientation during the swing; (e) an input system for receiving input data regarding the swing path of the golf club and/or the golf club orientation during the swing from an external source; (f) a computer processing system engaged with at least one of the golf club head, the shaft, or the grip member, wherein the computer processing system performs at least one function selected from the group consisting of: receiving input data regarding swing path of the golf club and/or the golf club orientation during a swing, receiving input data regarding a first change to an adjustable golf club parameter, generating data regarding swing path of the golf club and/or the golf club orientation during the swing, and generating data regarding the first change to the adjustable golf club parameter, and wherein the computer processing system additionally transmits golf club parameter change information based on the data regarding the swing path, the data regarding the golf club orientation, and/or the data regarding the first change; and/or (g) a golf club parameter adjustment system included with at least one of the golf club head, the shaft, or the grip member. The golf club parameter adjustment system receives the golf club parameter change information from the computer processing system and changes at least a first parameter of the golf club such that the first parameter is at a first setting at a beginning of the swing and at a second setting different from the first setting at a ball strike time during the swing.

The golf club parameter(s) may be adjusted in any of the manners described above and any of the manners described in more detail below, including, for example, adjustment of lie angle, loft angle, face angle, shaft stiffness, shaft kickpoint location, weighting, weight positioning, face flexibility, maximum face flex location, etc. Additionally, systems of this type also may use any of the additional input data described above, including, for example, one or more of: ball launch monitor data from previous swings, weather input data, course condition input data for a location of play, course design input data for a location of play, daily course layout input data for a location and a time of play, golfer past performance data (e.g., recent past performance, past performances at the location of play, past performance during an ongoing round of golf (i.e., on earlier played holes), etc.), current adjustable club setting information, and information indicating the specific hole being played.

Additional potential features of this aspect of this invention relate to methods of operating and/or using the equipment described above, e.g., to provide golf swing information and/or adjustable golf club setting information. Such methods may include at least some steps performed by a computer (such as receiving input data, transmitting output data, collecting sensor data, storing data, processing data, generating output, displaying output, etc.). Still additional aspects of this invention may relate to computer readable media that include computer executable instructions stored thereon for operating the hardware systems and/or performing the methods described above (and described in more detail below).

Specific examples of the invention are described in more detail below. The reader should understand that these specific examples are set forth merely to illustrate examples of the invention, and they should not be construed as limiting the invention.

B. Specific Examples of Systems and Methods According to the Invention

The various figures in this application illustrate examples of features of systems and methods of optimizing adjustable golf club settings and/or golf equipment selection in accordance with examples of this invention. When the same reference number appears in more than one drawing, that reference number is used consistently in this specification and the drawings to refer to the same or similar parts throughout.

1. General Background Information Relating to this Invention

FIG. 1A provides an exploded view of the various parts involved in one releasable golf club head and shaft connection assembly, e.g., like the STR8-FIT® golf club systems available from NIKE Golf, Inc. of Ft. Worth, Tex. In this example connection system, a golf club shaft 106 is connected with the hosel 102 of a golf club head by various parts. More specifically, first a club head adapter element 110 is engaged with the hosel 102 of the golf club head in a permanent manner (e.g., by adhesives or cements, by welding or other soldering techniques, etc.). Likewise, a shaft adapter 112 is engaged with the free end of the shaft 106 in a permanent manner (e.g., by adhesives or cements, by welding or other soldering techniques, etc.), with the securing element 114, the optional retaining ring 116, and the optional ferrule 118 provided on the shaft 106 above the shaft adapter 112. The outside of the shaft adapter 112 includes a plurality of splines 112*a* that fit into corresponding spline structures provided in the interior chamber of the club head adapter 110. The splines 112*a* allow for a releasable connection between the head adapter 110 and the shaft adapter 112 and prevent rotation of these parts with respect to one another. Once the various parts are in place, the securing element 114 fits over the exposed end of the shaft adapter 112, and the interior threads 114*a* on the securing element 114 engage the exterior threads 110*a* on the club head adapter 110 to secure the club head with the shaft 106. The retaining ring 116 can be placed around the shaft 106 in an appropriate location to maintain the securing element 114 and/or the ferrule 118 on the shaft 106 when the shaft 106 is disconnected from the club head.

Figure 1B:
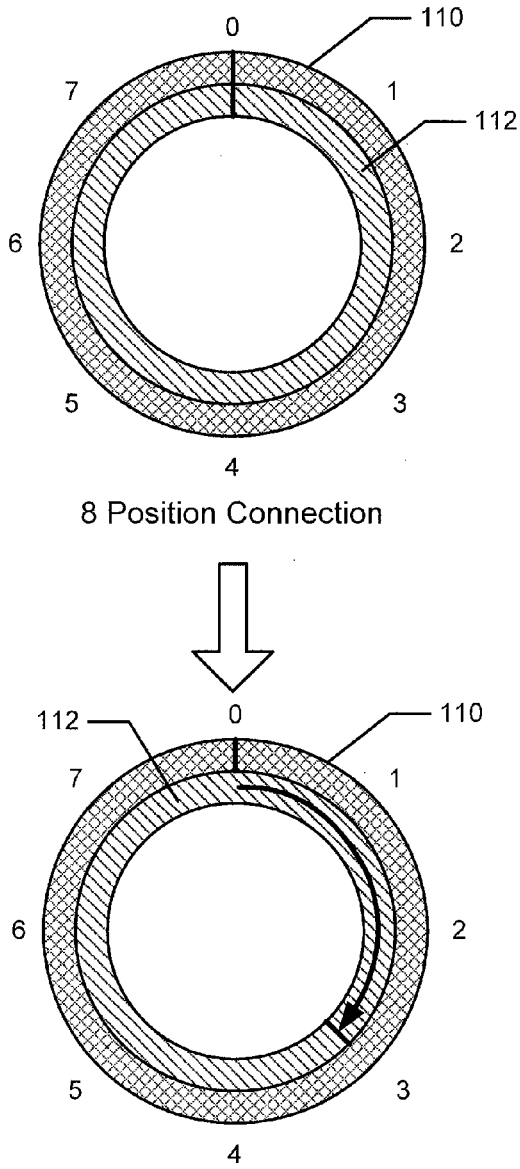
Fig. 1B (Prior Art)
Figure 1C:
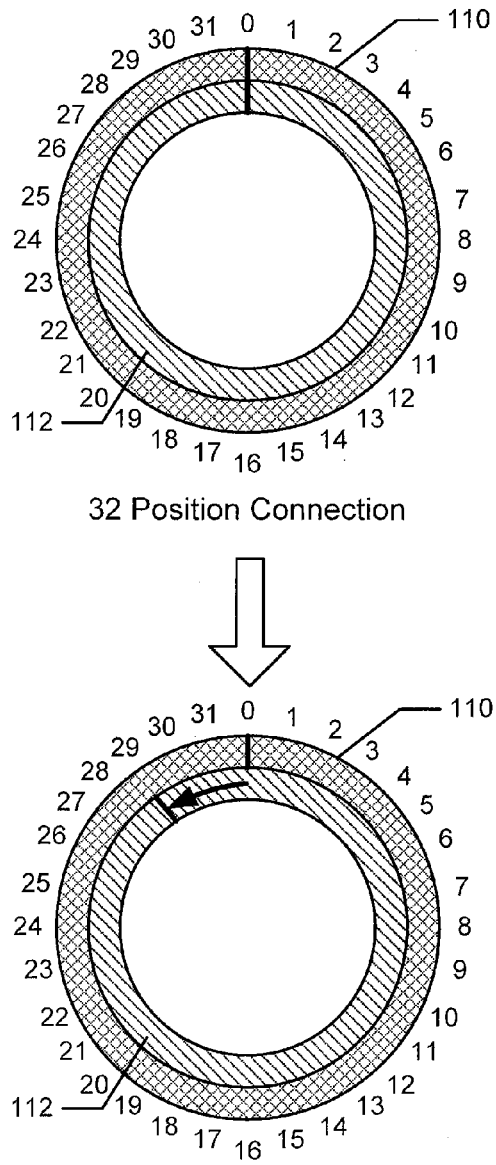
Fig. 1C (Prior Art)

The axis of the interior chamber of the shaft adapter 112 (which receives the shaft 106) may be offset with respect to the axis of the exterior of the shaft adapter 112 (which fits into the interior of the club head adapter 110). This offset angle may be, for example, about 2°. In this manner, rotation of the shaft 106 (and its attached shaft adapter 112) with respect to the club head hosel 102 changes the orientation of the club head face with respect to the shaft 106. Through this structure, rotation of the shaft 106 with respect to the club head hosel 102 can be used to change and control one or more of the lie angle, loft angle, and/or face angle of the club head. This rotation is illustrated schematically in FIGS. 1B and 1C. FIGS. 1B and 1C generally illustrate the relative positioning and change of position of the club head adapter 110 with respect to the shaft adapter 112 in an assembled golf club head (much of the detail is omitted from these figures to prevent obscuring the relevant information for this discussion). FIG. 1B illustrates an adjustable golf club head/shaft connection product in which the shaft adapter 112 (and thus the shaft 106) may be placed at 8 different rotational positions with respect to the club head adapter 110 (and thus the club head). Rotation of one with respect to the other, as shown by a comparison of the top and bottom of FIG. 1B and the movement of the shaft adapter 112 from Position 0 to Position 3, will have the effect of altering the lie angle, loft angle, and face angle of the club head. Likewise, FIG. 1C illustrates an adjustable golf club head/shaft connection product in which the shaft adapter 112 (and thus the shaft 106) may be placed at 32 different rotational positions with respect to the club head adapter 110 (and thus the club head). Rotation of one with respect to the other, as shown by a comparison of the top and bottom of FIG. 1C and the movement of the shaft adapter 112 from Position 0 to Position 29, will have the effect of altering the lie angle, loft angle, and face angle of the club head.

Currently available NIKE commercial adjustable golf club products have 8 or 32 rotational positions available, as described above. The head/shaft connection rotational orientation is the only adjustability feature in these commercially available clubs. Even this relatively straightforward adjustment system and mechanism, however, can be daunting and overwhelming for some golfers, as it can be difficult for a golfer to know or predict, with any degree of certainty, whether the specific settings are optimum for a given day of play and/or for a given golf course (especially when the player is unfamiliar with the golf course). Moreover, if printed information regarding the differences produced at the different settings is not available to the golfer, the golfer may be reluctant to make any setting changes (for fear of making the settings worse instead of more optimum).

Figure 2:
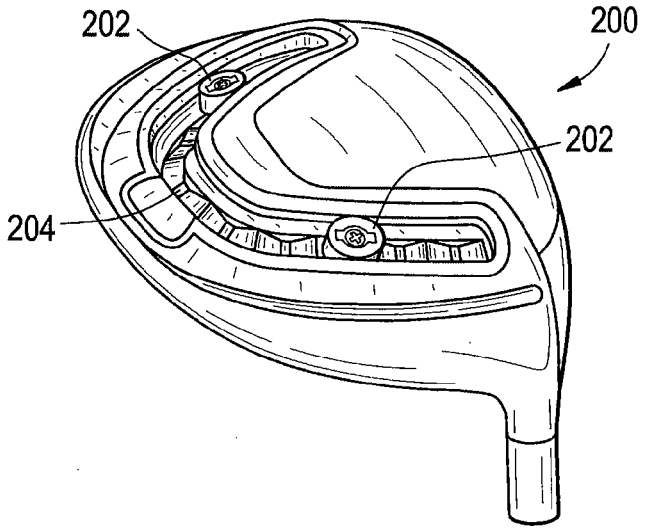
FIG. 2 Prior Art

Other commercially available products have more adjustable parts and/or more potential settings. For example, FIG. 2 illustrates an example commercial golf club structure 200 that includes two different weight members 202 (each 8 grams) that are mountable at 10 different mounting positions along a rail 204 provided in the sole of the club head. Movement of the weights 202 can be used to affect (or control) the trajectory of the golf ball when launched by the driver 200. Thus, this club 200 provides 45 different potential weight settings (and thus ball trajectory settings) from which the user can select when adjusting the club 200. If one were to provide weights 202 of different mass from one another as well as head/shaft adjustability, this would further increase the available adjustable club settings available to users.

Figure 3:
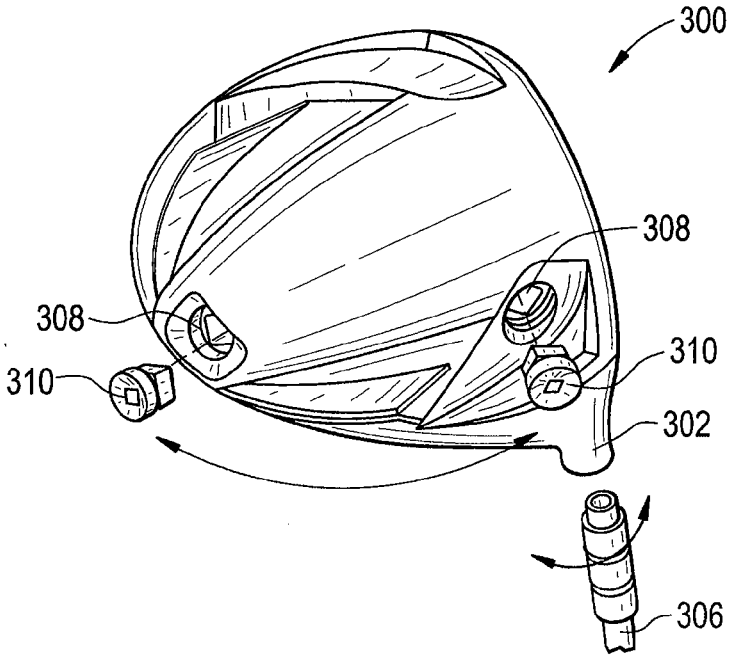
FIG. 3 Prior Art

FIG. 3 illustrates a commercially available club 300 having three adjustable setting features. One adjustable feature is a removable shaft 306 that is rotatable to 12 different positions with respect to the hosel 302 of the club head. Additionally, the sole of the club head includes two weight ports 308 (one port 308 at the club heel and one in the far rear), and the club 300 comes with a kit that includes 4 different weights 310 that may engage the two ports 308 (two weights 310 at a time engaged with the head). The commercial kit includes one 3 gram weight, two 7 gram weights, and one 11 gram weight that may be engaged with the weight ports 308 on the club head. By flip-flopping and/or selecting different weight combinations and shaft/head settings, 84 different adjustable golf club settings are available on this club product 300. This number of potential settings could be further increased, if desired, e.g., by simply changing the two seven gram weights to two weights of different mass (e.g., one 7 gram and one 9 gram).

Figure 4A:
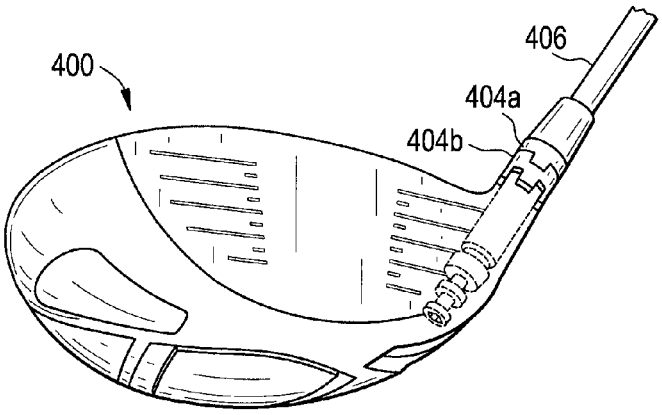
FIG. 4A Prior Art
Figure 4B:
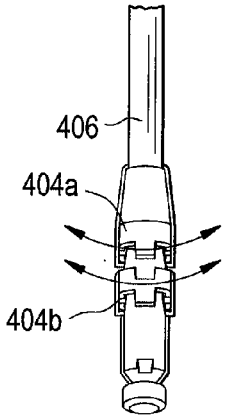
FIG. 4B Prior Art
Figure 4C:
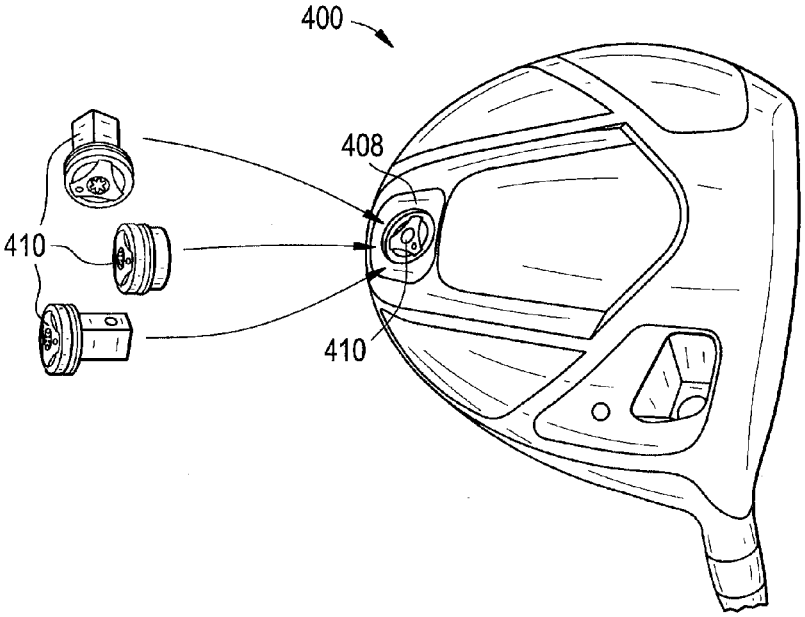
FIG. 4C Prior Art

Still other adjustability options are available. As shown in FIGS. 4A through 4C, this commercially available club 400 has a releasable golf club head/shaft connection assembly in which the shaft 406 has two adjustable hosel rings 404*a* and 404*b* (the hosel rings 404*a* and 404*b* are rotatable with respect to shaft 406). By selecting and adjusting the positions of these two hosel rings 404*a* and 404*b*, the lie angle of the club 400 can be adjusted between −0.75° flat and +1.5° upright (between the two rings 404*a* and 404*b*, sixteen different lie/loft settings are available). Moreover, this club 400 includes a single weight port 408 (at the far rear of the club 400's sole) into which one of three different weights 410 (each with different masses) may be attached. Thus, with the 16 different hosel ring 404*a* and 404*b* combinations, plus the 3 different weights 410, 48 different adjustable club settings are available for this club 400.

Figure 5:
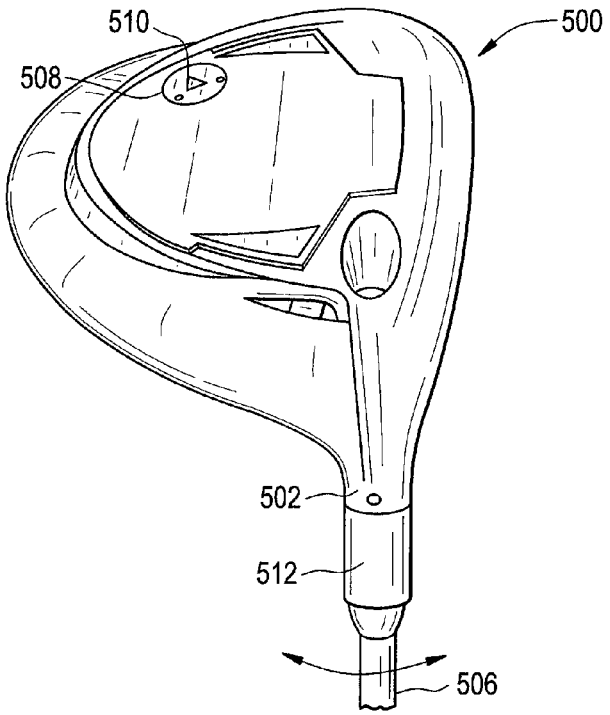
FIG. 5 Prior Art

FIG. 5 illustrates a golf club 500 that includes a releasable shaft 506 and hosel 502 connection that is rotatable to a plurality of different positions to allow adjustment of the lie and loft angles. Using this system, the user can change: (a) the face angle between open, closed, and neutral positions, (b) the lie angle from standard to 1° upright, and (c) the loft angle from 1° stronger to 1° weaker. This product 500 also includes an adjustable shaft length feature. More specifically, the golf club 500 comes with a kit that allows the user to select a different spacer 512 so that a different overall shaft 506 length may be provided on the club head (e.g., 45 inches, 45.5 inches, or 46 inches). The kit further includes different weights 510 that fit into a weight port 508 provided on the club's sole. The appropriate weight 510 is selected based on the spacer 512 selected, so as to control the club swingweight.

Figure 6:
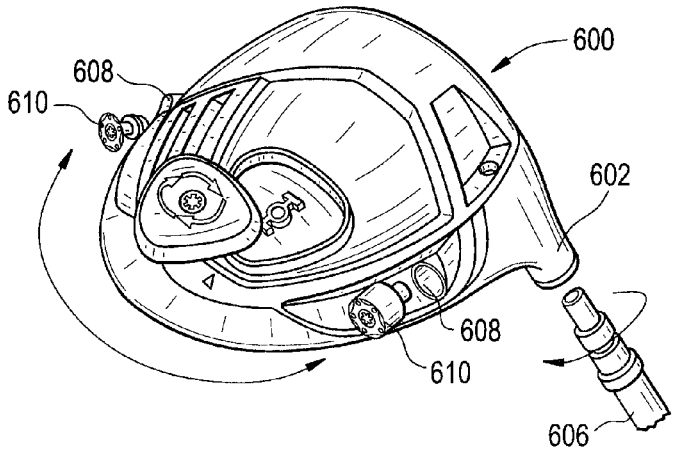
FIG. 6 Prior Art

Another commercially available golf club 600 is illustrated in FIG. 6. Like several other examples discussed above, this golf club 600 includes a releasable shaft 606 and hosel 602 connection that allows adjustment of various club head angles (the commercial club 600 has 8 different shaft/hosel settings). Additionally, the club 600 includes two weight ports 608 with two releasable weights 610 engageable therewith. Finally, this club 600 also includes an adjustable sole plate that is rotatable between three different orientations, to allow the face angle to be adjusted between open, closed, and neutral. In total, this specific commercial version provides 48 different adjustable club settings.

As is evident from the discussion of FIGS. 1A through 6, currently commercially available adjustable golf clubs have numerous potential adjustable club settings and/or several parts that may be adjusted and/or interchanged. It can be overwhelming both in time and complexity, particularly for new golfers or amateurs, to try to figure out how to use the various adjustment mechanisms and the impact that any individual adjustment may have on the ball's flight. Moreover, some adjustments will affect more than one variable (e.g., modification of the face angle may cause changes to the lie angle and/or the loft angle, at least in some of these club structures), which can further lead to confusion and frustration in trying to locate the optimum club settings. When one adds to all of this complexity the additional variables of tuning an adjustable club to best match the design and condition of a course to be played and/or weather conditions to be encountered during play, the myriad of variables to be considered in attempting to optimize the adjustable club settings for a round of golf can indeed be overwhelming. This may lead to frustration for the golfer or cause the golfer to simply ignore the available technology.

Accordingly, aspects of this invention seek to provide better information to the golfer to enable them to more readily set the adjustable golf club settings on their clubs in a manner designed to help optimize the club parameters for play.

Figure 7:
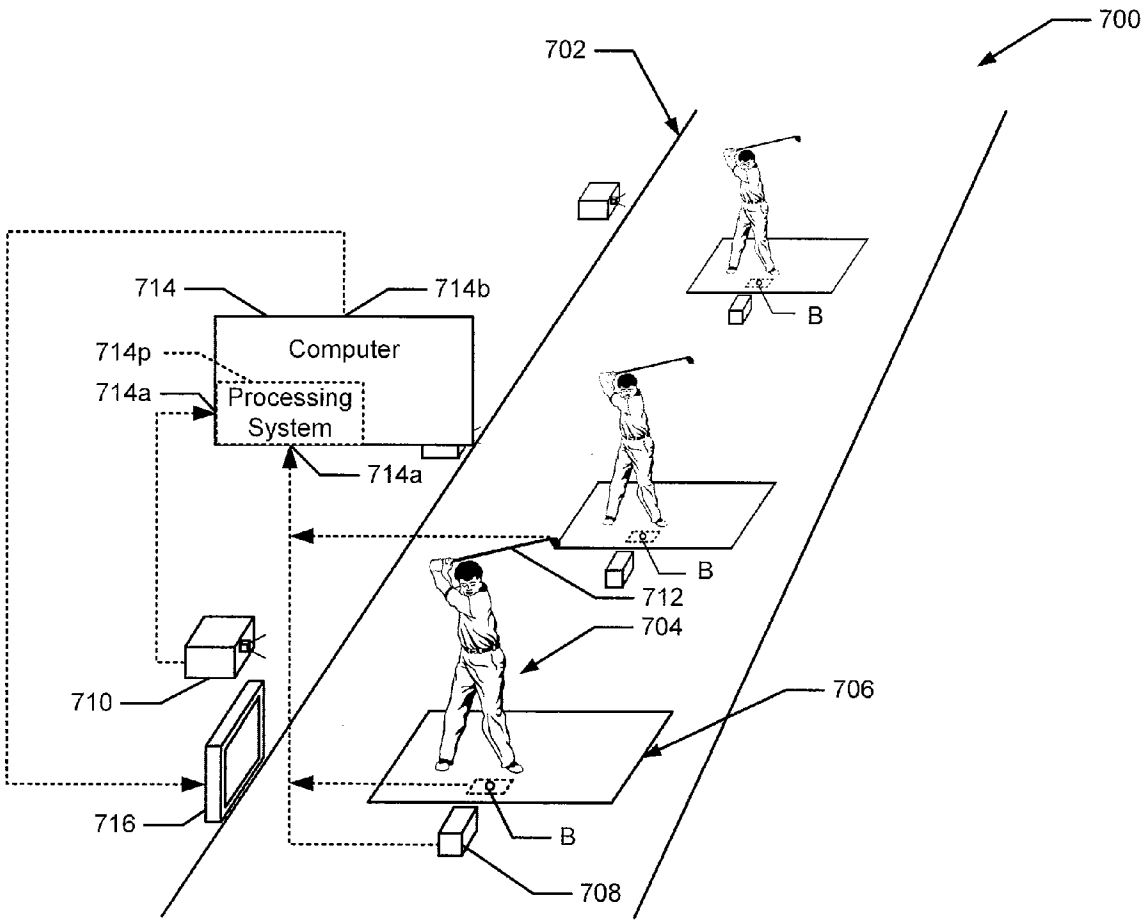
FIGS. 7 and 8 illustrate various example environments and features of systems and methods according to at least some examples of this invention.

2. Example Golf Club Adjustability and/or Equipment Selection Systems and Methods According to this Invention FIG. 7 illustrates one example of a system 700 and method according to at least one aspect of this invention. As shown, FIG. 7 illustrates a driving range tee 702, which optionally may be located at a golf course to be played by individual golfer 704. At least one ball hitting bay or hitting station 706 may be equipped with ball launch monitoring equipment 708 and/or video equipment 710 to record various features of the golfer's swing, the swing path, the club orientation, and/or the ball's flight. Such equipment is conventionally known and used in the art and is commercially available. As the user warms up and prepares for an upcoming round (optionally, a round to be started at the location of the driving range tee 702 within a short period of time), the ball launch monitoring equipment 708 and/or video equipment 710 can be used to record data relating to at least some of the golfer's swings on the driving range tee 702. Additionally or alternatively, if desired, sensors may be provided in the club 712, worn by the golfer (e.g., in a golf glove), and/or provided in the ball B to provide any desired data, as will be discussed in more detail below.

The ball launch monitoring equipment 708, the video camera equipment 710, and/or other available sensors can provide various types of input data to an input port 714*a* of a computer 714 (e.g., any desired type of input port, including wired or wireless connections). The various sensors may provide the necessary or desired data and/or the processing system 714*p* of the computer 714 may calculate the necessary or desired data based on the input data from one or more sensors. Examples of data that may be measured or calculated include, but are not limited to: club head speed at ball contact, face angle at ball contact, club head path, ball launch speed, ball spin (back spin, side spin, etc.), ball launch angle, ball flight path, ball curvature, ball deviation from center, carry distance, total distance, apex height, and apex distance.

The computer processing system 714*p* will take the input data and generate adjustable golf club setting data based on the sensor input and/or the calculated ball flight data. Any desired algorithm can be used to generate the golf club setting data. For example, if the sensor data indicates an outside-to-inside club head path (especially at ball contact) with an open club face, the computer processing system 714*p* may generate adjustable golf club setting data indicating that the club face should be closed somewhat from a neutral position (e.g., 0.5°, 1°, 1.5°, 2°, or even more), optionally depending on the severity of the outside-to-inside club head path, the amount of imparted sidespin on the ball, etc. Also, if necessary to improve the ball's flight (e.g., its initial launch angle, its spin, etc.), the data might indicate that the loft angle of the club should be adjusted upward or downward. The computer processing system 714*p* also may receive input data indicating the type (e.g., make, model, etc.) of golf ball B to be used by the player 704, which information also may impact the ball flight (and thus the optimum club settings). The input data also may include the type of adjustable club being used (e.g., make, model, etc.) by the player, such as the types shown in FIGS. 1A through 6 above, to enable the output to be tailored to the specific adjustability features available on the player's club.

Once determined by the computer processing system 714*p*, the computer system 714 may generate appropriate output data and transmit it to an output device 716 via output port 714*b*. Any type of output port 714*b* and/or connection between the computer system 714 and the output device 716 may be used without departing from the invention, including a wired or wireless connection using any desired transmission protocol. As one specific example, the output device 716 may be a computer monitor and/or computer speaker in operative connection with the computer system 714 in a conventional manner, e.g., to provide an audio and/or digital display. The output device 716 may be located at or near the location of the range tee 702 (e.g., with an output device 716 for each hitting bay 706, with multiple hitting bays 706 sharing a single output device 716, with a single output device for the entire driving range, etc.). If desired, this same output device 716 may display launch monitor data or other information regarding the user's individual swings, e.g., as data is being collected for determining the adjustable golf club settings. As another example, the output device 716 may be the golfer's cellular telephone or other portable electronic device (such as a golf GPS device), and the communication therewith may be wireless, optionally over a cellular telephone network, the Internet, or other communication network.

The output provided via the output device 716 in at least some examples of systems and methods according to this invention may provide recommendations to the golfer as to which particular adjustable golf club settings should be used on the adjustable golf club based on the ball launch data and/or other collected data. As some more specific examples, the adjustable club setting information output to the golfer may include information relating to one or more of: a suggested lie angle setting for the golf club; a suggested loft angle setting for the golf club; a suggested face angle setting for the golf club; suggested weighting parameters for the golf club (e.g., suggested weighting for one or more specific weight locations on the golf club, suggested weight positions for one or more weights to be engaged with the golf club, weight selection information for one or more weight port locations on the golf club head, etc.); suggested relative positioning (e.g., rotational position) of the golf club head with respect to the golf club shaft (e.g., to control a lie angle, a face angle, and/or a loft angle of the golf club); suggested rotational positions of one or more hosel rings; suggested size and/or selection of one or more shaft length spacers; suggested rotational position of one or more sole plate members; suggested shaft stiffness/flexibility information; suggested shaft kick-point location information; information suggesting an orientation of an adjustable sole member with respect to a golf club head with which it is to be engaged; suggested face flexibility information; suggested maximum face flexibility location information; etc.

As noted above, the computer system 714 also may generate output indicating golf equipment recommendations for the player, for the upcoming round, based on the input data. A variety of different equipment selection options may be provided without departing from this invention, such as shaft flexes (e.g., for use on clubs with interchangeable shafts), different club heads (for use on clubs with interchangeable heads), different ball models, etc. As another example, the computer system 714 may have access to input data indicating an individual player's inventory of clubs (e.g., all golf clubs owned by and/or available to the individual player for use on a given day). Then, given the input data from the player's measured swings (as well as any other input data provided as described below), the system may make recommendations for the player as to which 14 clubs from the player's personal inventory to carry for that given round (e.g., replace a high lofted wedge with a fairway wood or hybrid, if the course is long or wet (or vice versa); replace one or more low lofted irons with hybrid clubs, etc.). Such equipment recommendations also may take into account the individual's past performances with that specific piece of equipment and/or on the specific course to be played.

The following Table provides some more specific examples of the manner in which the output may be provided and/or the potential content of the output for the various club structures described above in conjunction with FIGS. 1A through 6:

| Club Construction | Example Setting Information |
|---|---|
| FIG. 1A and 1B | Rotate Shaft to Position 3 |
| FIG. 1A and 1C | Rotate Shaft to Position 29 |
| FIG. 2 | Mount Weight 1 at Position 3 and Mount Weight 2 at Position 8 |
| FIG. 3 | Rotate Shaft to Position 7; Place Weight 1 (3 grams) in the Rear Position; Place Weight 4 (11 grams) in the Heel Position |
| FIGS. 4A through 4C | Mount Top Hosel Ring at Position 2; Mount Bottom Hosel Ring at Position B; Mount Weight 2 in the Weight Port |
| FIG. 5 | Rotate Shaft to the Upright Position; Engage Spacer C (1 inch) Between the Shaft and Club Head; Engage Weight 3 in the Weight Port |
| FIG. 6 | Rotate Shaft to Position 4; Mount the 12 gram Weight in the Heel Position; Mount the 3 gram Weight in the Toe Position; Rotate the Sole Plate to the Closed Position |

Once the necessary club setting adjustments are made, if desired, the golfer can again hit balls on the driving range tee 702, optionally using the sensing technology illustrated in FIG. 7, to see whether the ball launch and flight data has improved from the original settings and swings. The golfer may make adjustments any number of times at the driving range prior to beginning a round of golf If desired, golf clubs or other components of systems in accordance with at least some examples of this invention may include one or more levers, switches, buttons (or other appropriate mechanical adjusting mechanisms or computer input devices) to allow for rapid and minor (or "fine tuning") adjustments in one or more parameters (e.g., moving a lever from one position to another toggles a club setting between a first value and a second value, for example, to change the face angle by 0.5° or to change a loft angle by 0.5°, no matter the actual angle setting). Then, as the golfer works on optimizing the ball flight, he/she can also make quick, minor, fine tuning adjustments to this parameter (e.g., without removing the head from the shaft, without removing a weight from the head or shaft, without changing an amount of weight on the head or shaft, without changing a position of a weight on the head or shaft, etc.), quickly hit another shot, and then determine whether they like the first position or second position better (e.g., akin to an eye examination where the doctor flips lenses between two positions and the patient states whether Option 1 or Option 2 is more clear). This quick, small adjustment feature can help players maintain a more consistent swing and rhythm as they test small variations in the settings (e.g., they can quickly hit another shot after a minor adjustment without completely removing the head from the club or making a major and rhythm disrupting adjustment to the club) and can help them better "dial in" or fine tune to the most optimal settings. The term "minor" adjustment as used herein, when applied to change of an angle of a golf club head (e.g., lie angle, loft angle, face angle, etc.), unless otherwise noted, means adjustment of the angle from its previous setting by 1° or less. In some specific systems and methods, minor adjustments of an angle may be by 0.75° or even 0.5° or less. Also, "minor" adjustments, as used herein, can typically be completed within 5 seconds, optionally without removing the head from the shaft, without removing a weight from the head or shaft, without changing an amount of weight on the head or shaft, and/or without changing a position of a weight on the head or shaft.

Golf clubs and systems with "minor" adjustment features, as noted above, also may include one or more major club head adjustment systems for changing the club head parameters. Such major club head adjustment systems may be activated and used, for example, by removing the head from the shaft and adjusting their rotational positions with respect to one another, by changing the positions of movable weights, by removing or interchanging weights, by changing the orientation of rotatable disks or other parts of the club head, by adding or changing shaft extension elements, etc. (e.g., adjustment systems as described above in conjunction with FIGS. 1A through 6).

Figure 8:
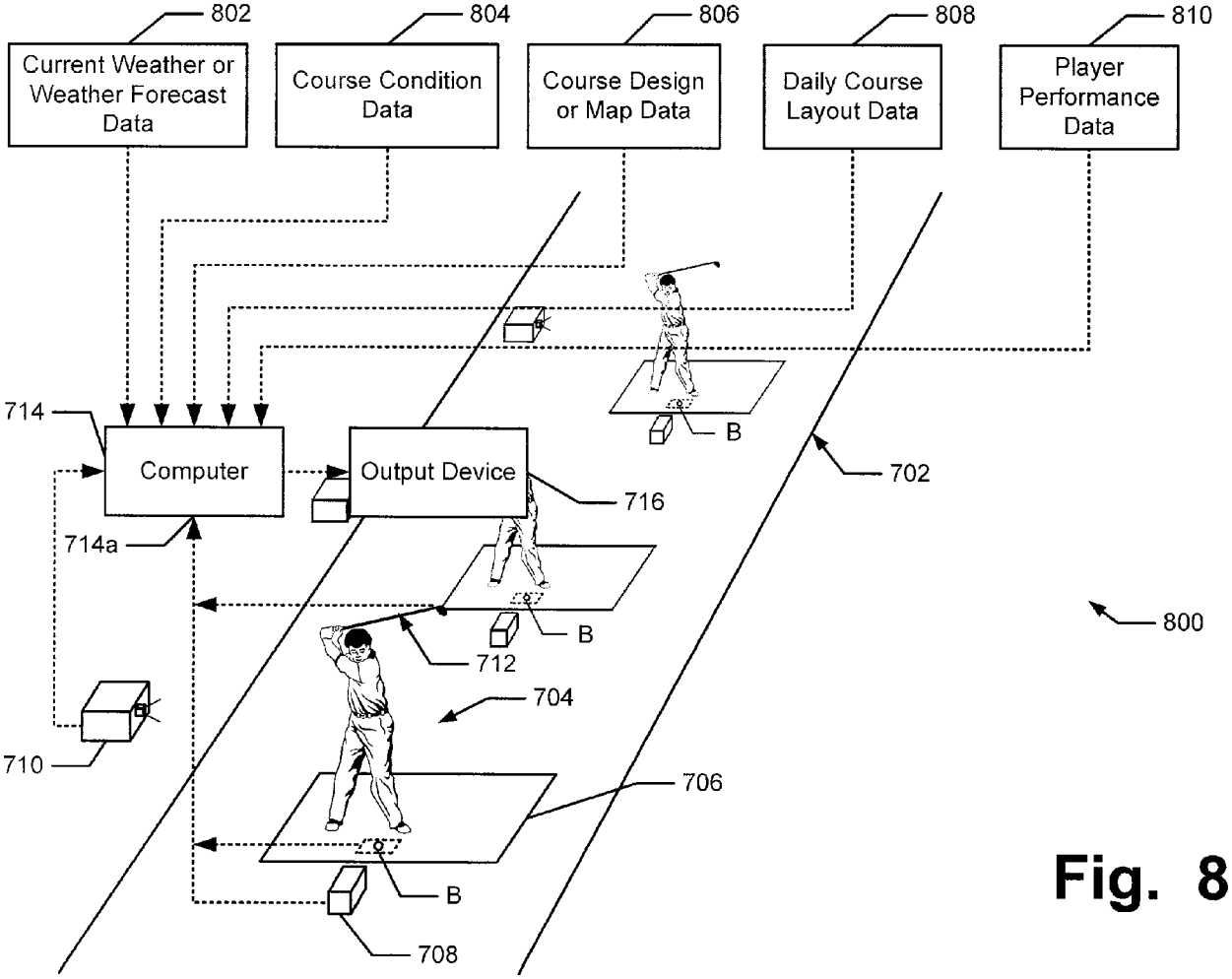

FIG. 8 illustrates another example golf club adjustment system 800 in accordance with this invention. Like the system 700 of FIG. 7, the system 800 of FIG. 8 may include similar equipment and elements, such as a driving range tee 702 having one or more ball hitting bays or hitting stations 706, at least some of which may be equipped with ball launch monitoring equipment 708 and/or video equipment 710 to record various features of the golfer's swing, the swing path, the club orientation, and/or the ball's flight. The ball launch monitoring equipment 708 and/or video equipment 710 can be used to record data relating to at least some of the golfer's swings on the driving range tee 702. Additionally or alternatively, if desired, sensors may be provided in the club 712, worn by the golfer (e.g., in a golf glove), and/or provided in the ball B to provide additional data. Other input data, such as ball type or club type, may be provided, as described above.

As with the system 700 of FIG. 7, in the system 800 of FIG. 8, the ball launch monitoring equipment 708, the video camera equipment 710, and/or other available sensors can provide various types of input data to an input port 714*a* of a computer 714. The computer 714 may provide output to an output device 716, e.g., of the various types described above.

The system 800 of FIG. 8, however, includes one or more additional potential sources of input data that may be used in determining appropriate adjustable golf club setting information and/or golf club equipment selection information for the player 704 for an approaching round of golf. For example, the computer 714 may further receive input (at any desired type of input device hardware, including wired or wireless connections) relating to at least one of: weather input data 802 relating to at least one of a time or a location to be played (weather forecast data and/or current weather data); course condition input data 804 relating to at least one of the time or the location to be played; course design or map input data 806 relating to the location of play; daily course layout input data 808 for at least one of the time or the location of play; and past performance input data 810 for the golfer (including, or optionally limited to, input data relating to the golfer's past performance at the location to be played and/or the golfer's recent performances). As another example, input data may include the player's available golf equipment inventory (e.g., the clubs, club parts, balls, and/or other equipment owned by and/or otherwise available to the player for playing this round of golf). As will be described in more detail below, some or all of this data may be used by systems and methods according to at least some examples of this invention to determine appropriate adjustable golf club setting information and/or golf equipment selection information for a golfer for an upcoming round of golf (optionally, a round to be played within a very short time, e.g., less than one day, less than one hour, etc.).

Additionally or alternatively, although not specifically identified in FIG. 8, the computer input system according to at least some examples of this invention may receive additional input data, such as current adjustable club setting input data (so any determined change can be considered in view of the existing adjustable club head settings). As yet additional options or alternatives, the adjustable golf club setting data may be generated at least in part based on input data indicating specific holes to be played by the golfer on the golf course to be played (e.g., if the golfer plans on playing only nine holes, e.g., holes 1 through 9 or 10 through 18).

Weather conditions can greatly impact ball launch conditions and ball flight/roll during play. For example, when it is cold, the ball may not travel as far as in warm conditions. Additionally, wind speed and wind direction can dramatically affect ball flight. Accordingly, it would be desirable to use adjustable golf club settings and/or specific equipment that optimize ball flight and/or roll for the golfer under the existing and/or predicted weather conditions for the round to be played (e.g., to bias the club to produce a low, boring trajectory; to bias the club to produce a high, wind-riding trajectory; to bias the club for inducing a more right-to-left ball flight; to bias the club for inducing a more left-to-right ball flight; to select a more or less "spin" model golf ball; to select a harder or softer golf ball model; to select specific clubs from an available club inventory; etc.). Therefore, in systems and methods in which the computer system 714 receives and utilizes weather input data 802 at least in part to generate the club setting and/or equipment selection information, the weather input data 802 may include one or more of: current weather information for a location of play, predicted weather information for the location of play over a time of play, current wind speed information for the location of play, predicted wind speed information for the location of play over the time of play, current wind direction information for the location of play, predicted wind direction information for the location of play over the time of play, prevailing wind direction information for the location of play, prevailing wind direction information for the location of play over the time of play, average wind speed information for the location of play, chance of rain (or other precipitation) over the time and at the location of play, amount of rain (or other precipitation) expected over the time and at the location of play, predicted temperature over the time of play, etc.

Course conditions also can greatly impact ball travel during play. For example, when the course is very dry or when the grass has been recently mown, the ball may roll farther (as compared to a very wet course and/or in deeper grass). Accordingly, it would be desirable to use adjustable golf club settings and/or to select golf equipment that optimize ball flight/roll for the golfer under the course conditions existing or expected at the time of play (e.g., to bias the club to produce a ball flight to generate more roll, more carry distance; to select balls or clubs to produce a more boring trajectory; etc.). Therefore, in systems and methods in which the computer system 714 receives and at least in part utilizes course condition input data 804, the course condition input data 804 may include one or more of: recent past weather information (e.g., dates and amounts of recent rainfalls, etc.); green, fairway, and/or rough height or thickness information (e.g., last mow date, mowing height, etc.); green, fairway, and/or rough hardness information; recent green, fairway, and/or rough watering information (e.g., when last watered, amount of water applied, etc.); green speed information (e.g., from Stimpmeter); fairway speed information; rough speed information; changes in conditions over the area of the course; etc.

The course design and individual hole designs also may influence the type of shot that a golfer should attempt to hit and/or preferred ball flight characteristics that will increase the player's chances for playing the hole with a minimum number of strokes. Accordingly, it would be desirable to use adjustable golf club settings and/or golf equipment selections that optimize ball flight for the golfer tailored to the course/hole designs that the golfer will face during the course of a round of golf (e.g., to bias the club to help produce a low trajectory; to bias the club to produce a high trajectory; to bias the club for inducing a right-to-left ball flight; to bias the club for inducing a left-to-right ball flight; to select equipment (clubs or balls) from an available inventory to produce a particular type of ball flight; etc.). This feature could be particularly advantageous for golfers playing a new or unfamiliar course. Accordingly, for systems and methods in which the computer system 714 receives and at least in part utilizes course design or map input data 806, the course design or map input data 806 may include one or more of: a number or percentage of holes having a dogleg left design, a number or percentage of holes having a dogleg right design, a number or percentage of holes having a straight design, a number or percentage of holes having a preferred right-to-left ball flight direction, a number or percentage of holes having a preferred left-to-right ball flight direction, locations of hazards, locations of hazards with respect to the location of the pin, locations of out of bounds, hill location information, hill slope information, fairway location or boundary information, a number of forced carries, a location of forced carries, and a ball flight distance required to clear any forced carries.

Additionally, for systems and methods in which the computer system 714 receives and at least in part utilizes daily course layout input data 808 for a location and a time of play, the daily course layout input data may include one or more of: tee marker position information for one or more holes, pin placement information for one or more holes, hole lengths (yardages), distances to hazards or out of bounds areas on individual holes, and distances to clear hazards or out of bounds areas on individual holes.

Moreover, systems and methods according to at least some examples of this invention may use this type of course design input data 806 and/or the daily course layout data 808 in combination with other data, such as the weather input data 802 and/or the course condition data 804 to determine recommended club setting information and/or golf equipment (clubs or balls) selection information. For example, changes in club setting information (e.g., to bias the club for particular ball flight characteristics) may be indicated if certain holes on the golf course will be playing against the predicted wind direction, with the predicted wind direction, in a right-to-left cross wind direction, or a left-to-right cross wind direction. Certain equipment selections also may be more optimum (e.g., including another hybrid v. a fourth wedge, using a specific model ball, etc.) under certain play/use conditions.

As noted above, in some example systems and methods according to this invention, the computer system 714 also may receive and at least in part utilize past performance input data 810 for the individual golfer 704 to generate the adjustable golf club setting data and/or golf equipment selection data. In such systems and methods, the golfer past performance input data 810 may include at least one of: ball flight information for the golfer 704 during one or more previous rounds (e.g., typically a left-to-right flight path, typically a right-to-left flight path, etc.); a number or percentage of out of bounds shots hit left by the golfer 704 during one or more previous rounds; a number or percentage of out of bounds shots hit right by the golfer 704 during one or more previous rounds; a number or frequency of left located hazards hit by the golfer 704 during one or more previous rounds; a number or frequency of right located hazards hit by the golfer 704 during one or more previous rounds; a number or percentage of fairways missed left by the golfer 704 during one or more previous rounds; a number or percentage of fairways missed right by the golfer 704 during one or more previous rounds; a number or percentage of greens missed left (e.g., in regulation) by the golfer 704 during one or more previous rounds; a number or percentage of greens missed right (e.g., in regulation) by the golfer 704 during one or more previous rounds; a number or percentage of fairways missed short by the golfer 704 during one or more previous rounds; a number or percentage of fairways missed long by the golfer 704 during one or more previous rounds (e.g., including fairways in which the golfer 704 drove it through a dogleg); a number or percentage of greens missed short (e.g., in regulation) by the golfer 704 during one or more previous rounds; and a number or percentage of greens missed long (e.g., in regulation) by the golfer 704 during one or more previous rounds. The player performance data 810 also may be limited to rounds played within a predetermined recent time frame, rounds played since a swing change or a lesson, a specific number of recently played rounds (e.g., the last 2 or 3 rounds), and/or rounds (recent or otherwise) on the specific golf course to be played. The player performance data 810 also may be correlated to the specific equipment used (e.g., balls or clubs) and/or the adjustable settings used during the past performance(s).

Optionally, in the system 800 of FIG. 8, the ball launch monitor 708 and/or the ball flight monitoring equipment 710 may be omitted, and the club adjustment data and/or golf equipment selection data may be determined using only one or more of the other data sources 802 through 810 described above (or other data mentioned above).

Typically, no single adjustable club head setting and/or equipment selection will be optimum for play of an entire round of golf on a given course, e.g., because the holes will run in various different directions, the holes have different set ups and features, etc. Systems and methods according to examples of this invention may provide club settings and equipment recommendations determined to be best for the majority of the holes (by any desired algorithm), optionally given the course design, weather, daily layout, and other conditions, as described above. These settings and recommendations, however, may not be optimal for all holes (e.g., very suitable for dogleg right-to-left holes but not as good for dogleg left-to-right holes). Some examples of systems and methods according to this invention may provide the player with warning information as to the holes and/or locations within the course where the settings may not be optimum and/or where special care should be exercised (e.g., specifically noting holes that dogleg the opposite way from the biased flight direction provided by the club head's settings, specifically noting holes with close out of bounds in the biased flight direction provided by the club head's settings, etc.). This information may enable the player to adjust his/her aiming points to minimize a poor result on those holes. As another example, systems and methods according to some examples of this invention could print out a customized yardage book for the player prior to the round that, in addition to providing yardages and course information, takes into account the club's settings, the player's past performance(s), the player's typical carry distances for various clubs, and the like, and optionally provides the player with customized hole-by-hole information, such as layup/go for it recommendations (e.g., to clear hazards), club selection recommendations (from the tee), aiming point suggestions, and the like. As another option, systems and methods according to at least some examples of this invention could take player performance information into account during the round and provide play recommendations at each specific holes. In this manner, systems and methods according to the invention may function somewhat like a personal caddy.

As described above, systems and methods according to at least some examples of this invention may provide recommendations for a ball for an individual player to play prior to a round, with the recommendation optionally based on one or more of: the individual course being played, the conditions of play (e.g., weather, course conditions, daily course layout, course design, etc.), the player's past performance (in general and/or on this specific golf course), etc. Systems and methods according to the invention are not limited to ball recommendations under these circumstances. As additional examples, if desired, systems and methods according to at least some examples of this invention may make new ball recommendations on a daily basis (e.g., based on the information above and/or optionally, based at least in part on the player's recent swings and/or swings on the range immediately prior to play). Additionally or alternatively, if desired, the ball recommendations may change during the course of the round, e.g., even on a hole-by-hole basis, if desired. The player could be advised of ball change recommendations, e.g., through an output device provided as part of a golf cart, through the player's cellular telephone or pager, via a golf GPS yardage system, or the like. Such systems may request that the player advise the system (as an input) of the type of ball being played so that systems and methods according to the invention can correlate the play of individual holes to the type of golf ball being played.

Figure 9A:
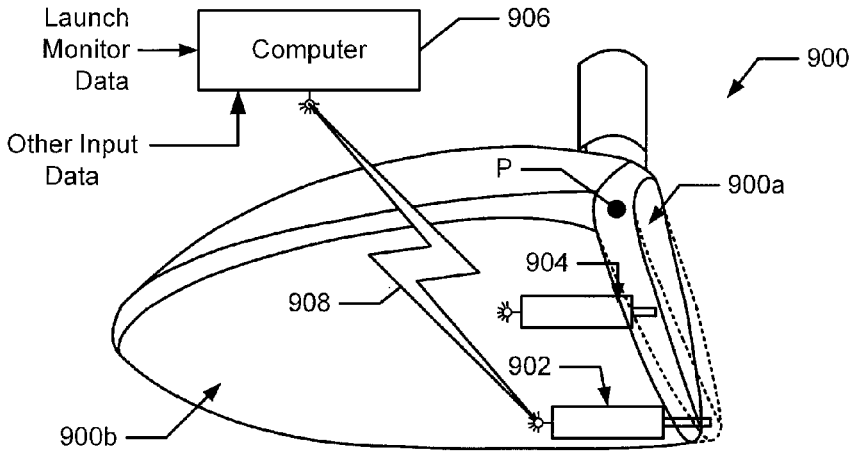
FIGS. 9A through 14 illustrate various examples of adjustable golf clubs or portions thereof that may be used in conjunction with at least some aspects of this invention.
Figure 9B:
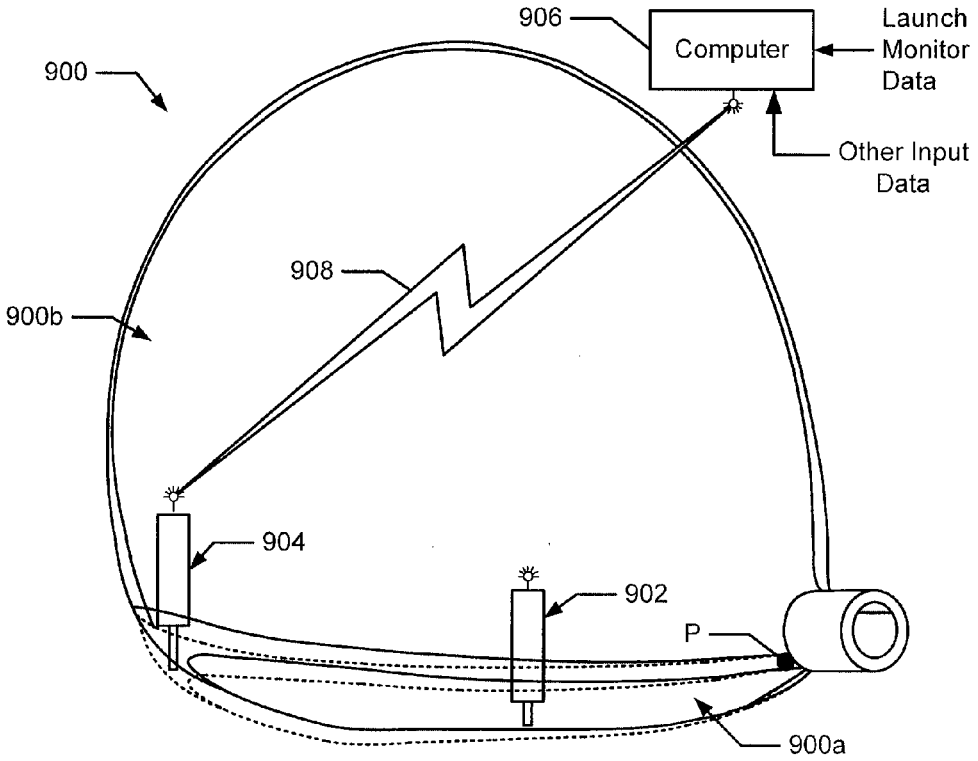

FIGS. 9A and 9B illustrate an example golf club head 900 that may be used in systems and methods according to at least some examples of this invention. In this example golf club head 900 (which is illustrated as a driver head but could be any desired type of club head), the head 900 includes two servo motors, one motor 902 used to adjust the club head's loft angle and one motor 904 used to adjust the club head's face angle. These motors 902 and 904 are in wireless electronic communication with a computer 906 (as shown by transmission icons 908), which receives launch monitor data and/or any other type of input data as described above in conjunction with FIGS. 7 and 8. Any desired type of communication or communication protocol may be used without departing from this invention. After the computer 906 receives all the necessary or available input data for determining appropriate loft and face angle settings for this user, optionally for a specific, upcoming round of golf (e.g., ball flight data, launch monitor data, weather information data 802, course condition data 804, course design data 806, daily course layout data 808, player performance data 810, etc.), the computer 906 can communicate with the loft angle adjustment motor 902 and/or the face angle adjustment motor 904 to set the loft angle and/or the face angle of the club head 900 to the optimum settings determined for the player (optionally, at a purchase point location, for the player's general use, for a given day's round, or for play of a given hole (or number of holes)).

FIG. 9A generally shows adjustment of the loft angle, with a first loft angle shown in solid lines and an increased loft angle shown in broken lines (e.g., by pushing the downward portion of the club face 900*a* outward about an upper pivot point P, which may be one or more axes, axles, pins, or hinge elements). The club face 900*a* may be connected to the club body 900*b* by an adjustable joint, such as a sliding joint (where the return portion of a cup face 900*a* slides into the interior of the walls of the club body 900*b*), a bellows or other expansion joint, etc. While the club head 900 may be adjustable over any desired range of loft angles without departing from this invention, for driver type golf clubs in accordance with at least some examples of this invention, the loft angle may be adjusted between 4° to 20°, and in some examples between 6° to 18°, or even between 8° to 16°. Other appropriate loft angle ranges may be provided for other clubs, including 3-woods, 5-woods, 7-woods, 9-woods, hybrids, irons, putters, and the like.

FIG. 9B generally shows adjustment of the face angle, with a first face angle shown in solid lines and a more closed face angle shown in broken lines (e.g., by pushing the outside portion of the club face 900*a* outward about a heel pivot point P, which may be one or more axes, axles, pins, or hinge elements). The club face 900*a* may be connected to the club body 900*b* by an adjustable joint, such as a sliding joint (where the return portion of the cup face 900*a* slides into the interior of the walls of the club body 900*b*), a bellows or other expansion joint, etc. If desired, the face angle motor 904 may operate independent of the loft angle motor 902, although both may be adjusted at once or within a single adjustment without departing from this invention. While the club head 900 may be adjustable over any desired range of face angles without departing from this invention, for driver type golf clubs in accordance with at least some examples of this invention, the face angle may be adjusted between 4° open to 4° closed, and in some examples between 3° open to 3° closed, or even between 2.5° open to 2.5° closed. These same or other desired face angle ranges may be provided for other clubs, including 3-woods, 5-woods, 7-woods, 9-woods, hybrids, irons, putters, and the like.

The computer 906 may be any desired device without departing from this invention, including the launch monitor itself (or a computer associated with the launch monitor), a separate computer running a fitting or adjustment session, or a computer in communication with one of these types of computers, such as a cellular telephone, a golf GPS type device, another user carried device, a cart mounted device, or the like. As another option, the computer 906 may receive input from a variety of other computers or sources to produce the adjustable golf club setting data and/or for sending it to the club head 900.

Figure 10A:
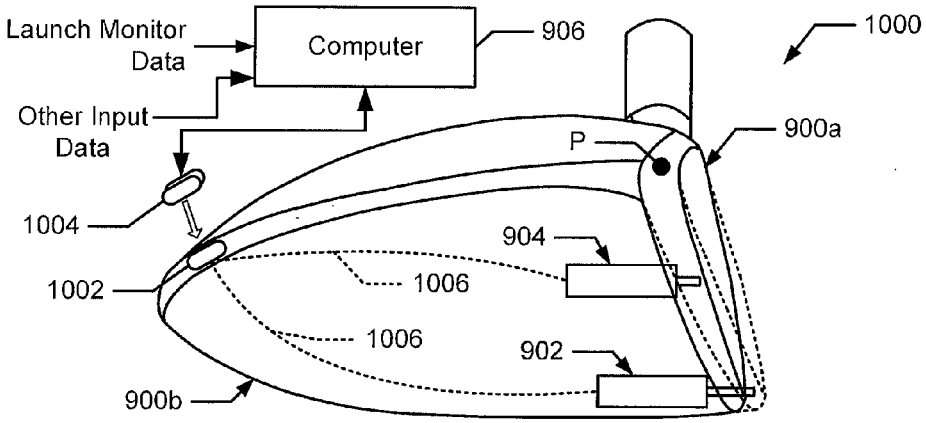
Figure 10B:
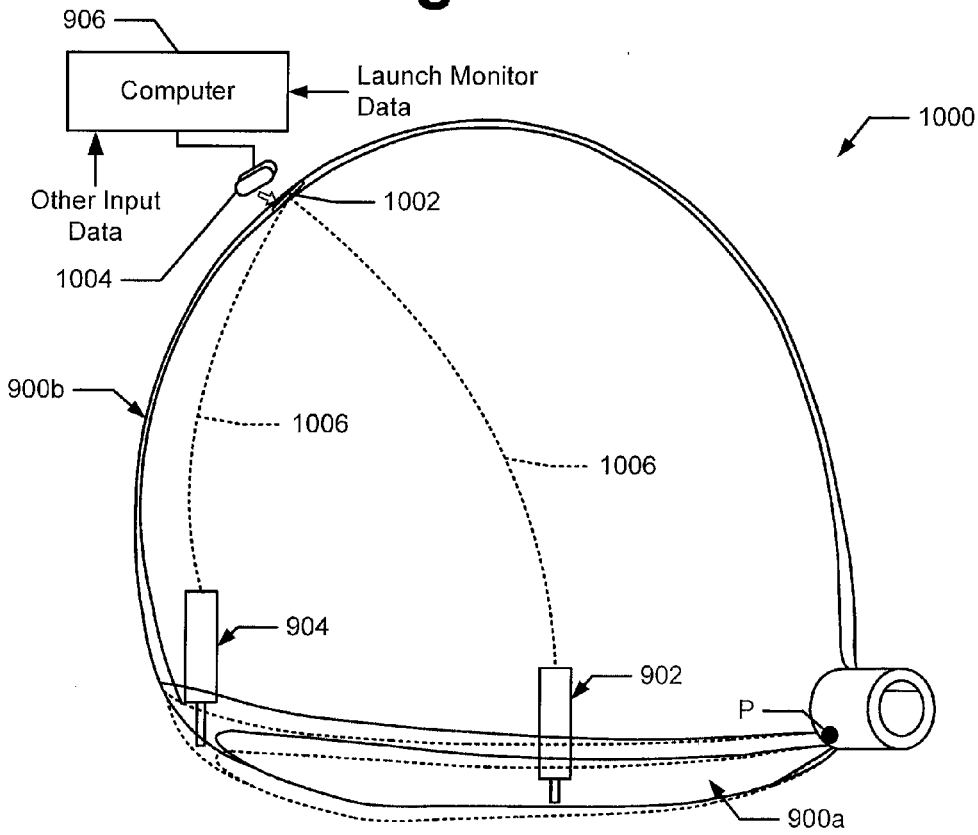

FIGS. 10A and 10B show a club head 1000 and adjustment system similar to those described above in conjunction with FIGS. 9A and 9B, except, in these structures, the golf club head 1000 includes a data input port 1002 that engages with a connector 1004 (optionally a wired connector) directly or indirectly connected to the computer 906. Any desired type of connector 1004 and input port 1002 structures may be used without departing from this invention, including, for example, Ethernet type connectors, USB type connectors, etc. The club head 1000 further includes one or more connectors 1006 for transmitting the data (e.g., club head adjustment data) from the input port 1002 to the motors 902 and 904. The connectors 1006 may be wires extending through the club head 1000 (e.g., through the open interior space of a hollow golf club head), electrical conductors deposited on interior surfaces of the club head body parts and/or the face member, optical fiber connectors, etc. Optionally, if desired, rather than a wired connector 1004 and input port 1002, the input port 1002 could receive input wirelessly (e.g., from computer 906) and distribute appropriate signals via connectors 1006 to adjust the settings of the motors 902 and 904 and the various club angles. The input port 1002 also may be provided at any desired location on the club head 1000, and/or also on the shaft, grip, or the like, without departing from this invention.

Figure 11:
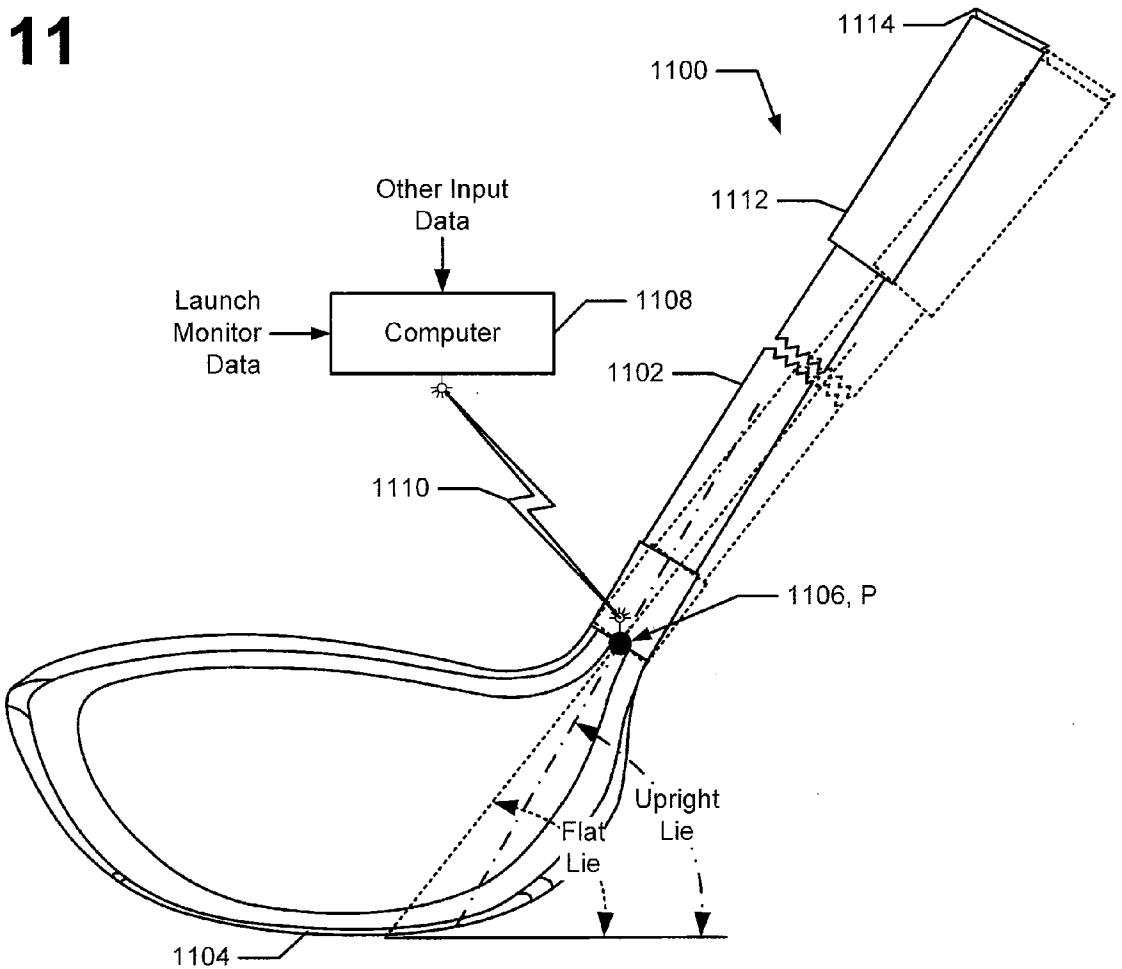

FIG. 11 illustrates another example golf club 1100 in accordance with this invention having another potential adjustable parameter, namely, an adjustable lie angle parameter (i.e., the angle between the shaft 1102 and the bottom of the club head 1104). Like the club heads described above in conjunction with FIGS. 9A through 10B, the example golf club head 1100 (which is illustrated as a driver head but could be any desired type of club head) includes an indexing motor 1106 or other appropriate mechanism used to adjust the angle of the club head (in this case, the lie angle is adjustable). The motor 1106 is in wireless electronic communication with a computer 1108 (as shown by transmission icon 1110), which receives launch monitor data and/or any other type of input data, e.g., as described above in conjunction with FIGS. 7 and 8. The computer 1108 may be any of the various types described above in conjunction with FIGS. 9A through 10B, and any desired type of communication or communication protocol may be used without departing from this invention. After the computer 1108 receives all the necessary input data for determining an appropriate lie angle setting for a specific user, optionally for a specific round of golf (e.g., ball flight data, launch monitor data, weather information data, course condition data, course design data, daily course layout data, player performance data, etc.), the computer 1108 can communicate with the lie angle adjustment motor 1106 to set the lie angle of the club head 1104 to the optimum settings determined for the player (optionally, at a purchase point location, for the player's general use, for a given day's round, or for play of a given hole (or number of holes)).

FIG. 11 generally shows adjustment of the lie angle with a first lie angle shown in solid lines and a flatter lie angle shown in broken lines (e.g., by rotating the free end of the shaft 1102 toward the ground about a pivot point P, which may be one or more axles, pins, or hinge elements). The shaft 1102 may be connected to the club body 1104 about any desired type of adjustable, rotatable joint. While the club head 1100 may be adjustable over any desired range of lie angles without departing from this invention, for driver type golf clubs in accordance with at least some examples of this invention, the lie angle may be adjusted between 6° upright to 6° flat, and in some examples between 4° upright to 4° flat, or even between 2° upright to 2° flat. These same or other desired lie angle ranges may be provided for other clubs, including 3-woods, 5-woods, 7-woods, 9-woods, hybrids, irons, putters, and the like.

If desired, the wireless communication illustrated in FIG. 11 may be changed to a wired or other data transmission system and protocol, e.g., like those described above in conjunction with FIGS. 10A and 10B. While the data input port (e.g., a USB type port, an Ethernet connection port, etc.) may be provided at any desired location on the club 1100 without departing from this invention, if desired, it may be provided at the free end of the grip 1112, optionally covered by an end cap 1114 or the like. Deposited conductors, optical fibers, wires, or the like, optionally located within the hollow interior of the shaft 1102, may carry the data from the input port at the grip 1112 to the motor 1106 or other angle adjusting mechanism.

Figure 12A:
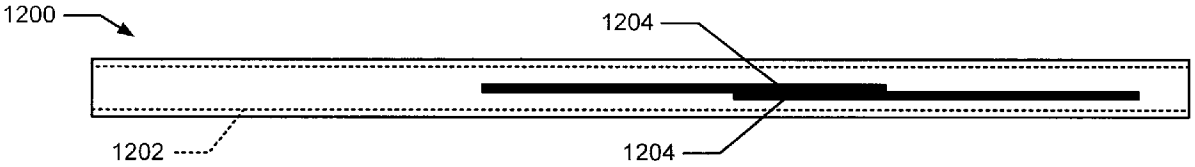
Figure 12B:
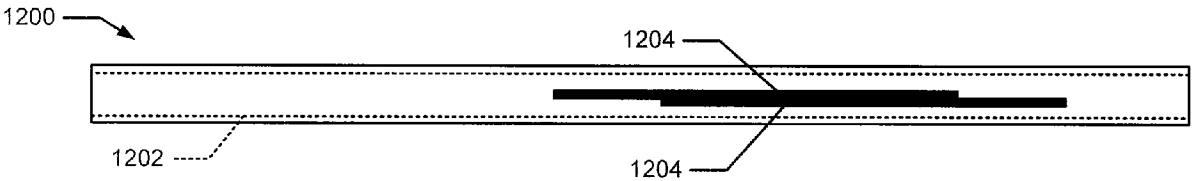
Figure 12C:
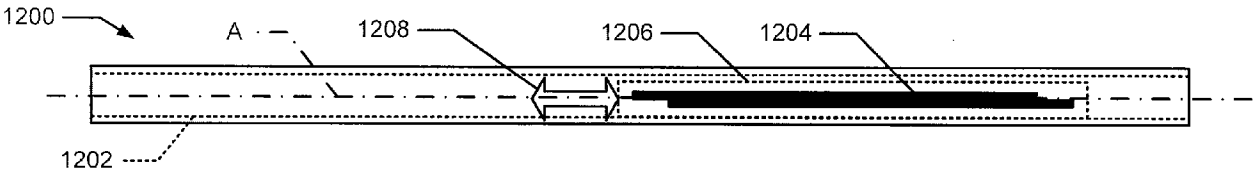

Other golf club parameters also may be adjusted using systems and methods according to at least some examples of this invention. As some additional examples, golf clubs may have various shaft stiffness adjustment parameters and mechanisms. FIGS. 12A through 12C illustrate some examples. As shown in FIGS. 12A and 12B, the interior hollow chamber 1202 of a shaft 1200 may include one or more movable plates, rods, half cylinders, or other support mechanisms or structures 1204. The support structures 1204 may be made of a flexible material (e.g., plastics, metal, etc.), and they may lie against one or more of the internal surfaces of the chamber 1202.

In the example structure shown in FIGS. 12A and 12B, two internal support structures 1204 will have contacting surfaces, and the degree of flex of the shaft 1200 will be controlled depending on the extent of the overlap of the two internal support structures 1204. FIG. 12A shows relatively little overlap on the internal support structures 1204, which in this example would result in a relatively flexible shaft 1200. FIG. 12B, and the other hand, shows a relatively large overlap on the internal support structures 1204, which would result in a relatively stiff shaft 1200. Adjustment of this overlap extent (e.g., using computer control systems of the types described above in conjunction with FIGS. 7 through 11 to control the relative positioning of the support structures 1204 and to move the support structures 1204 with respect to one another, e.g., by sliding, etc.) may be used to adjust and control the shaft flexibility, and it will allow customization of the club's flexibility to a specific user's optimum settings. These optimum settings may be selected, for example, at a purchase point location, for the player's general use, for a given day's round, or for play of a given hole (or number of holes).

FIG. 12C illustrates another example shaft parameter that may be controlled in golf clubs in accordance with at least some examples of this invention, namely, the shaft's bend profile and/or kickpoint location (e.g., the location at which the shaft 1200 shows the greatest amount of bend as the bottom portion of the shaft 1200 (including a club head) is flexed during a golf swing). In this example structure, the shaft 1200 includes an interior chamber 1202 in which a flex control assembly 1206 is provided (e.g., including one or more internal support structures 1204 of the types described above). This flex control assembly 1206 may be moved to any desired position along the shaft axis, thereby allowing control of the axial location of the maximum bend in the shaft 1200 in use during a golf swing. FIG. 12C generally illustrates the flex control assembly location adjustment system as the double headed arrow at reference number 1208. Adjustment of the flex control assembly location (e.g., using computer control systems of the types described above in conjunction with FIGS. 7 through 11 to control the relative positioning of the assembly 1206 and to move the assembly 1206 with respect to the shaft interior 1202) may be used to adjust and control the shaft flexibility, and it will allow customization of the club's flexibility to a specific user's optimum settings. These optimum settings may be selected, for example, at a purchase point location, for the player's general use, for a given day's round, or for play of a given hole (or number of holes).

As some more specific examples, the exterior of the assembly 1206 may be threaded, and those threads may interact with internal threads provided on the chamber interior 1202 of the shaft 1200. The adjustment system 1208 may include a motor, shaft, or other device that rotates the assembly 1206 with respect to the shaft interior 1202, which in turn moves the assembly in the axial direction A along the shaft interior 1202.

Figures 13A, 13B:
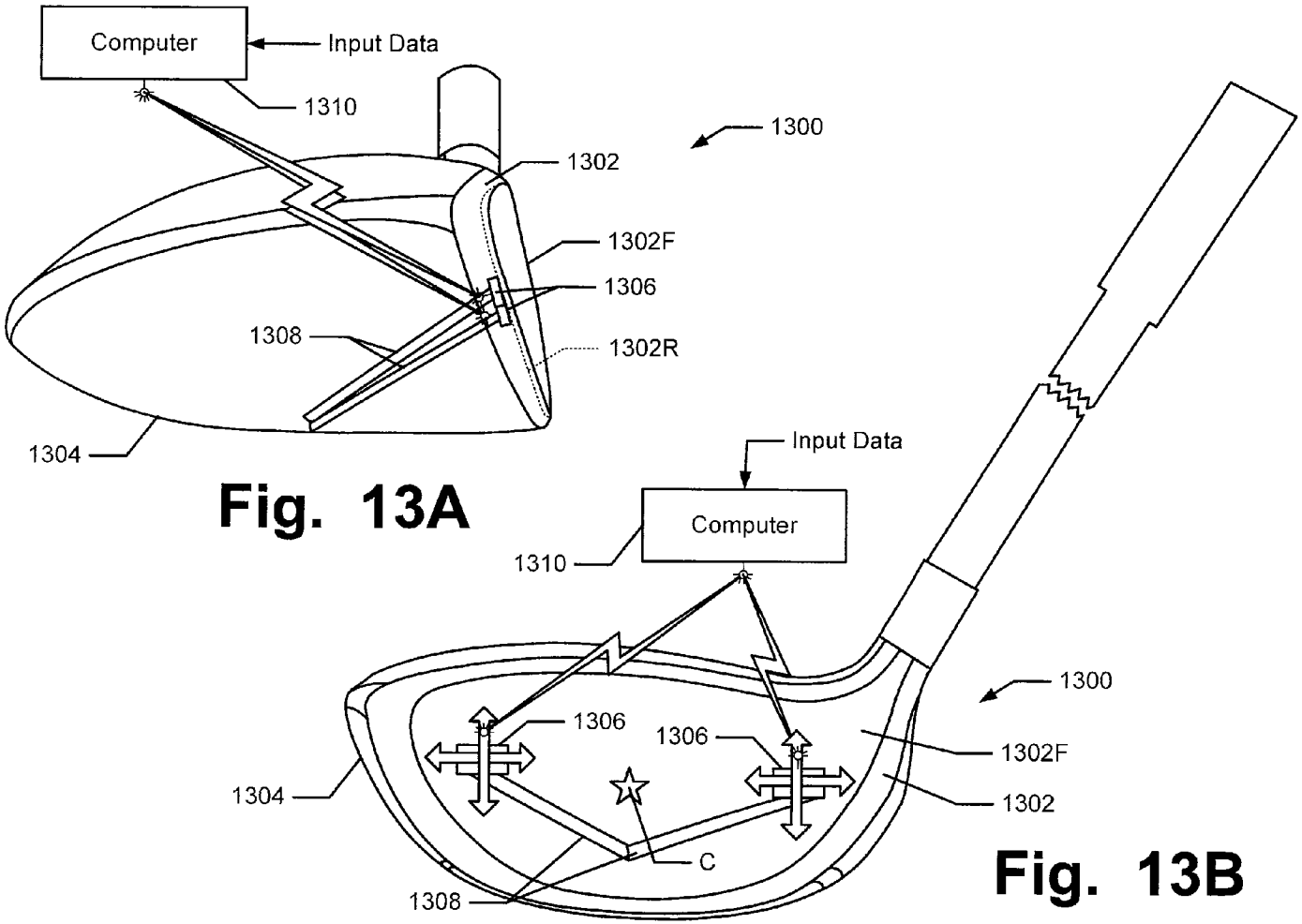

Face flex characteristics are additional parameters that may be controlled using systems and methods according to at least some examples of this invention. FIGS. 13A through 13D provide some examples of adjustment of these parameters. More specifically, as shown in FIGS. 13A and 13B, golf club heads 1300 in accordance with this example of the invention include a face member 1302 and a body member 1304. The face member 1302 in this example structure 1300 may be made very thin and flexible, and one or more supports or stop elements 1306 may be provided behind the rear surface 1302R of the ball striking face 1302F. The stop element(s) 1306 may be provided to prevent over-flexure of the ball striking face 1302F, e.g., to prevent damage or failure of the face 1302F, to allow for maximum flexibility at the location of ball contact C, and/or to assure compliance with USGA regulations regarding face flexibility and COR.

The stop elements 1306 may be mounted on arms 1308 (e.g., telescoping arms, flexible arms, or the like) or may be otherwise movable with respect to the rear surface 1302R of the ball striking face 1302F (e.g., movable along rails or other structures provided on, at, or near the rear surface 1302R), so that the stop element(s) 1306 may be located at multiple positions with respect to the rear surface 1302R of the face 1302F. Moreover, the location(s) of the stop element(s) 1306 may be controlled by a computer 1310, and the appropriate location(s) of the stop element(s) 1306 may be optimized to provide a maximum COR response to the club face 1302 for a specific user. Any desired type of input may be provided to the computer 1310 to determine the optimum location(s) of the stop element(s) 1306, including any of the various types of input data described above in conjunction with FIGS. 7 and 8. Also, any type of data communication (wired or wireless), communication protocols, and the like (e.g., as described above) may be used without departing from this invention. The stop elements 1306 may lie against the rear surface 1302R, or they may be spaced from it when the face 1302 is in an unflexed condition.

As some more specific examples of this aspect of the invention, while hitting balls, sensors included in systems and methods according to at least some examples of this invention (e.g., impact sensors, cameras, launch monitor equipment, etc.) may note a player's tendency to hit the ball at certain locations on the face 1302 (e.g., toward the toe, toward the hosel, high, low, etc.). A player's tendencies in this regard also can potentially be determined using impact tape, powder, or other similar substances on the face 1302. If a player's general or predominant contact location can be determined, the stop elements 1306 can be positioned, under computer 1310 control, somewhat away from that location C to enable maximum or increased flex of the face at that location (which in turn will produce a maximum or increased COR response by the club head 1300, which should result in maximum or increased ball flight distance).

Figures 13C, 13D:
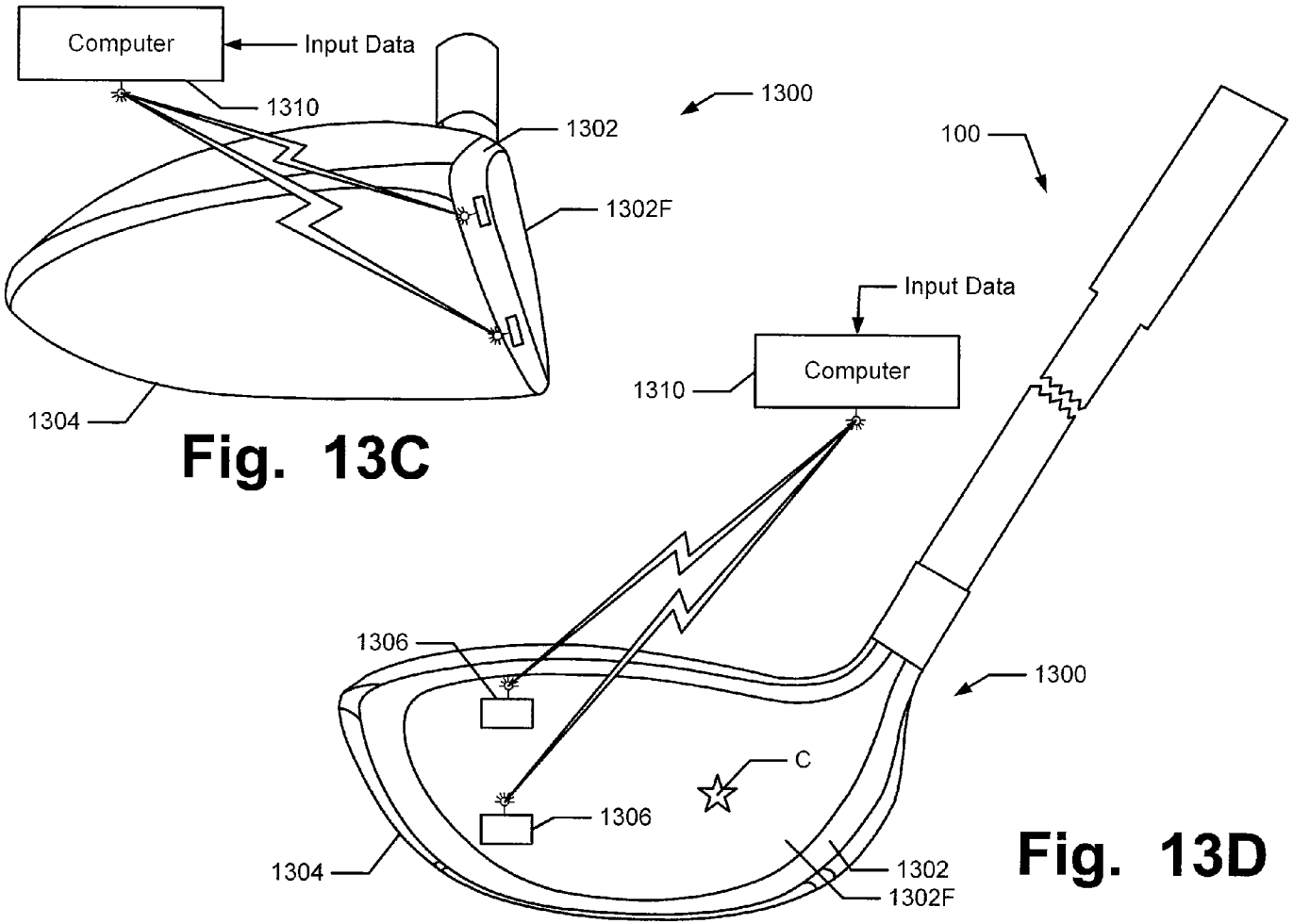

Comparisons of FIGS. 13A and 13B with FIGS. 13C and 13D, respectively, illustrate an example of changes to the adjustable club settings that may be provided in this example aspect of the invention. More specifically, FIGS. 13A and 13B illustrate one potential arrangement of two stop elements 1306 that may be used for players that tend to produce ball contact C at the center of the face (or, optionally, for players with no clearly discernable predominant contact location). If input data for a specific user shows that the user has a tendency to hit the ball toward the heel of the face (e.g., predominantly between the club face center and the hosel), the computer 1310 may control either or both of the stop element(s) 1306 to move toward the toe area of the face 1302, to provide maximum flexibility at the heel area (i.e., at the area of predominant ball contact with the face 1302). This change is illustrated in FIGS. 13C and 13D. In this manner, the flexibility of the golf club face 1302 can be optimized for individual players, e.g., at a purchase point location, for the player's general use, for a given day's round (e.g., on the driving range before a round), or even for play of a given hole (or number of holes) (e.g., given the user's tendencies on a specific day). Moreover, by positioning the stop element(s) 1306 far toward the heel, the face 1302 should still give the same or a similar COR response when the ball contacts toward the middle of the face 1302 (e.g., as shown in FIG. 13A).

Other appropriate locations for one or more stop element(s) 1306 with respect to the face 1302 may be determined for other off center hits through the use of routine experimentation. Also, the stop element(s) 1306 need not directly contact the rear side 1302R of the face 1302 at all times, although they may do so, if desired. In some example structures in accordance with this invention, the stop element(s) 1306 may be positioned somewhat spaced from the rear surface 1302R of the face 1302 in order to provide a maximum COR response at all ball/club face contact positions, at least at lower swing speeds. The stop element(s) 306 may be positioned so that they interact and support the rear surface 1302R of the face 1302 only under certain circumstances. For example, the stop element(s) 306 may be positioned so that at high swing speeds excessive face flex is prevented to thereby prevent cracking, caving in, or other failure of the face 1302. As another example, stop element(s) 306 may be positioned so as to prevent flexure of the face 1302 beyond a point at which the COR response of the face 1302 would violate the Rules of Golf (e.g., produce a COR response greater than 0.83). In this manner, the face can be made as thin as possible in order to maximize the flex and COR response at all (or more) swing speeds while still maintaining the structural integrity of the project and potentially keeping the product within the Rules of Golf Also, if desired, the computer systems of FIGS. 9A through 13D also may be provided with buttons or other input devices that allow for quick "minor" adjustments to one or more club parameters, as described above. Alternatively, if desired, one or more mechanical or electronic components on the various club heads or shafts may be used to produce the minor adjustments noted above (e.g., a lever, screw, or turnbuckle to move the face in one direction or the other by a small amount to change the face or loft angle; a slider to move one or more shaft stiffness components a small amount in one direction or the other; a spring loaded mechanism to allow adjustment of a club component by a small amount in one direction or the other; a motor to allow movement of the face or shaft by a small incremental amount; etc.).

Figure 14:
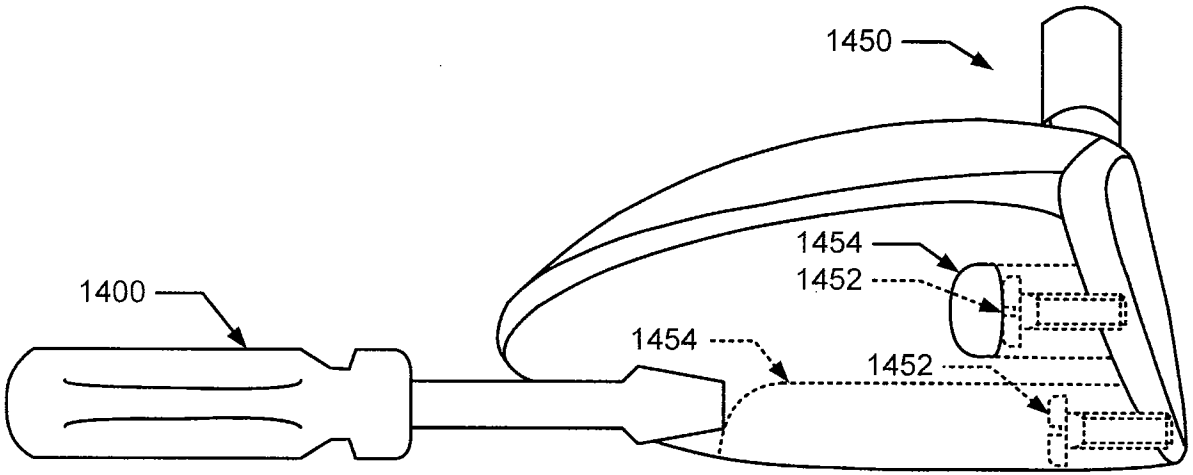

Various figures provided above illustrate golf club products equipped with motors or other systems that communicate with a computer and translate the adjustment data to actual changes in golf club settings. This type of arrangement is not a requirement. Rather, if desired, golf clubs, like golf club head 1450 illustrated in FIG. 14, may include manually manipulatable screws 1452 or other adjustment mechanisms that allow changes to be made to the characteristics and parameters of the golf club. While other arrangements are possible for adjusting other parameters, the screws 1452 in the example structure 1450 shown in FIG. 14 allow for manual adjustment of the loft angle and the face angle in a manner similar to that described above in conjunction with FIGS. 9A through 10B. The screws 1452 may be accessed through openings or ports 1454 provided at the exterior of the club head 1450. If desired, the screws 1452 may be provided in a manner so as to be manually accessible by the user, e.g., using a conventional screwdriver 1400, Allen wrench, or other adjusting tool. The head 1450 or other club component may be provided with one or more gauges or other devices that allow the various angles and/or other settings (e.g., face angle, loft angle, lie angle, shaft flex, shaft kickpoint location, face flexibility, etc.) on the club to be determined. Thus, armed with data from a fitting and adjustment computer (e.g., like those described above), a user could manually set the club head 1450 and/or club at the computer recommended settings.

FIGS. 15A through 15D illustrate additional example features that may be included with golf clubs, systems, and methods according to at least some examples of this invention. More specifically, FIGS. 15A through 15D illustrate an example golf club adjustment station 1500 that includes a chamber 1504 for receiving at least a portion of a golf club to be adjusted (the chamber 1504 in FIG. 15A receives at least a portion of golf club head 1550). This example adjustment station 1500 further includes one or more mechanisms (two mechanisms, 1510A and 1510B shown in FIGS. 15A through 15D) for engaging the golf club head 1550 (or other part of an adjustable golf club), interacting with mechanical or other systems provided in the club for adjusting club parameters (e.g., like the face angle and loft angle adjustment screws 1552), and adjusting the club parameters to desired settings. Optionally, information regarding the desired club settings may be transmitted to a computer processing system 1502 (e.g., one or more microprocessors) provided as part of the club adjustment station 1500 from another source, such as the various computer systems described above in conjunction with FIGS. 7 through 13D, from a keyboard or other manual input device, etc. Alternatively, if desired, this club adjustment station 1500 could be provided to directly receive some or all of the input data described above, e.g., ball launch data, swing path data, weather data, course condition data, course design data, course daily layout data, player past performance data, etc. As yet another option, the adjustment station 1500 may be located on the golf course driving range as shown in FIG. 8, at a retail purchase location, at a club fitting station, or at any other desired location(s).

Figure 15A:
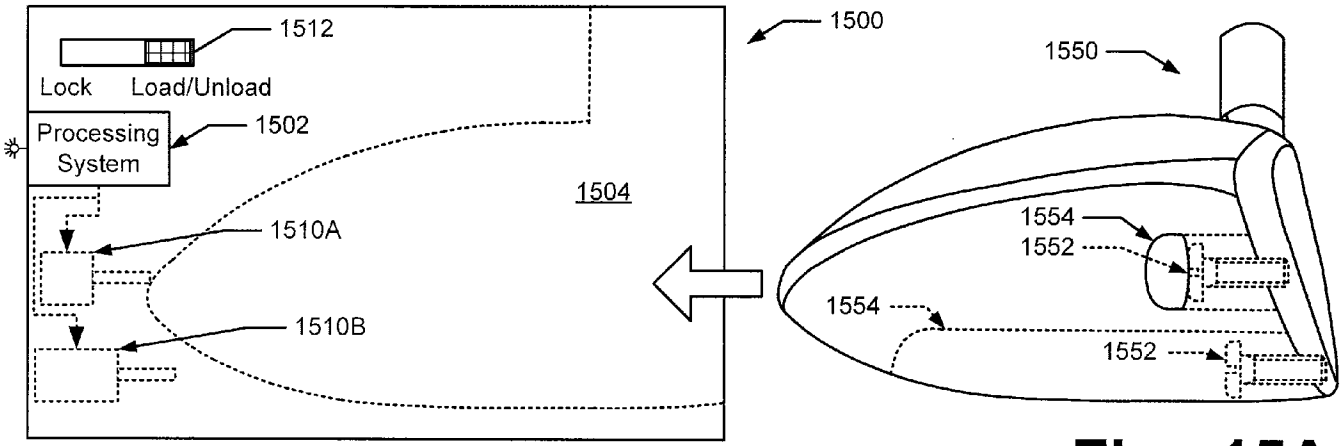
FIGS. 15A through 15D illustrate an example golf club adjustment station that may be provided and/or used in accordance with at least some aspects of this invention.
Figure 15B:
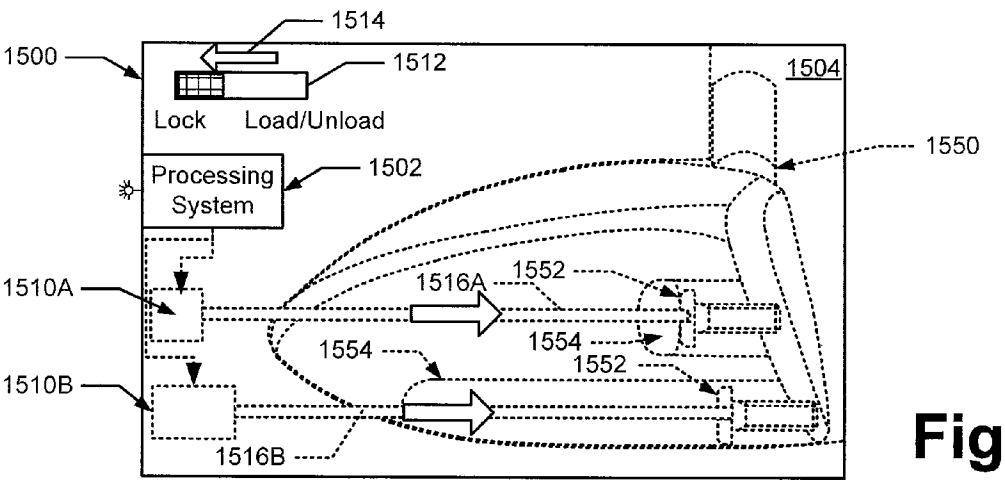

Operation of this example adjustment station 1500 will be described in more detail in conjunction with FIGS. 15A through 15D. At any time during the process, the processing system 1502 may receive data indicating club adjustment information for this specific user (e.g., face angle setting information, loft angle setting information, lie angle setting information, shaft flexibility setting information, face flexibility setting information, etc.) or data from which the adjustment information may be derived (e.g., ball launch data, swing path data, weather data, course condition data, course design data, course daily layout data, player past performance data, etc.). Optionally, the system may advise the user that updated club setting information is available (e.g., due to past performance, as the user approaches the tee or driving range), for example, by providing output at the user's cellular telephone indicating that new club setting adjustment data is available, if adjustments are desired. To begin the adjustment, first the golf club head 1550 (or other portion of a golf club) is fit into the chamber 1504 of the adjustment station 1500, as shown in FIG. 15B. Once inserted into the chamber 1504 and secured into place, optionally by activating a locking mechanism such as lock switch 1512 (e.g., moving the switch 1512 from the "Load/Unload" position to the "Lock" position, as shown by arrow 1514 in FIG. 15B), the club head 1550 is ready to be adjusted.

Activating the lock switch 1512 (or other desired action, such as pushing a START button) also can initiate the adjustment process. Optionally, the first step in the process may be to determine the current club head settings for the various angles or other parameter(s) to be adjusted (e.g., so systems and methods according to the invention will know how much adjustment is necessary). If desired, the adjustment station 1500 may be equipped with sensors that can make the necessary determinations of the existing settings (e.g., for the existing face angle setting, loft angle setting, lie angle setting, shaft flexibility setting, face flexibility setting, etc.). Alternatively, the existing setting information may be provided to the processing system 1502 as some of the input data. As yet another alternative, if desired, the adjustment information sent to processing system 1502 may have already taken into account any existing setting information. As still another alternative, if desired, the processing system 1502 could query or request setting information from memory or other electronics provided as part of the golf club structure.

Figure 15C:
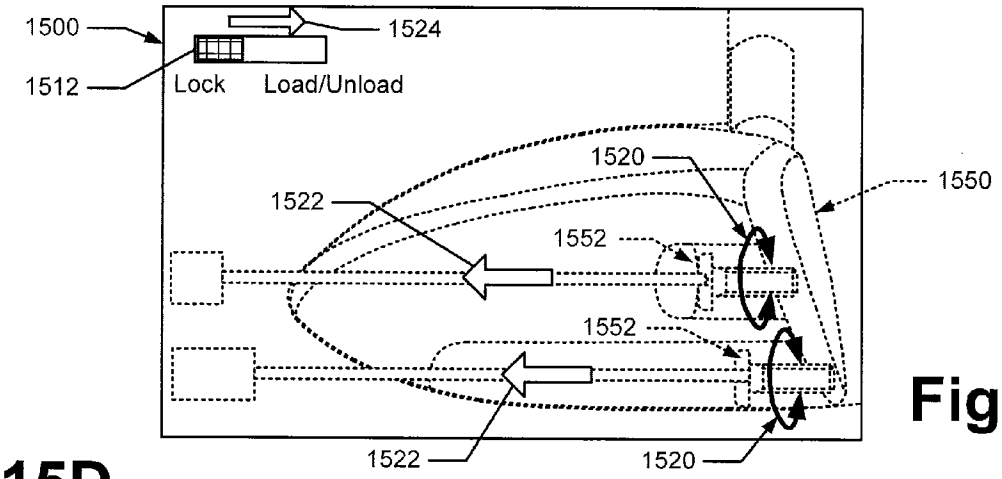
Figure 15D:
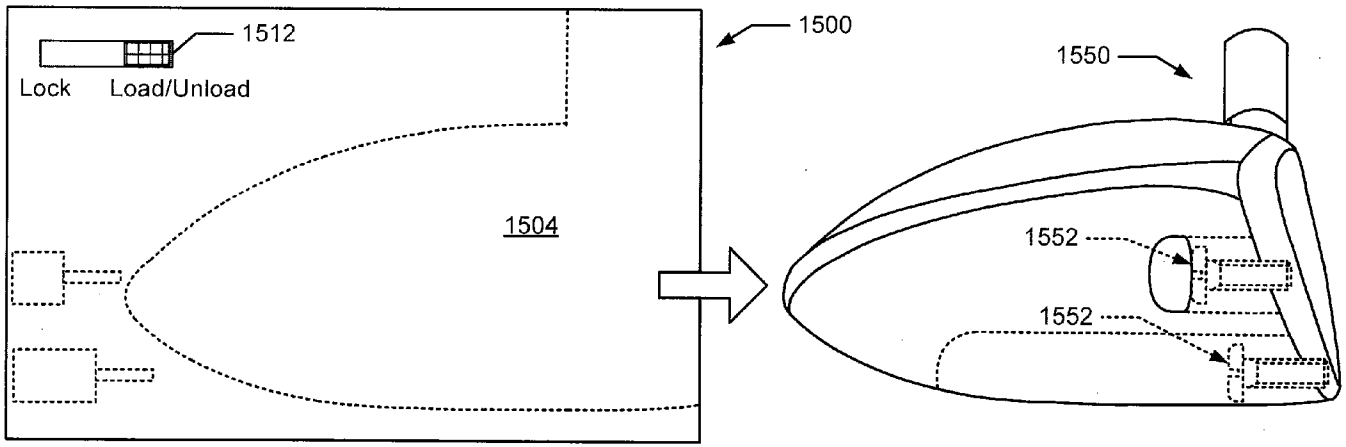

Next, the actual physical adjustment process is initiated. First, the adjustment mechanisms 1510A and 1510B are activated (if necessary) to engage the adjustment screws 1552 (or other mechanisms) provided on the club head 1550 (or other club component). Examples of this are shown in FIG. 15B by extension of the drive shafts 1516A and 1516B from the adjustment mechanisms 1510A and 1510B into engagement with the adjustment screws 1552. The ends of the drive shafts 1516A and 1516B may include heads that enable engagement and interaction with the adjustment screws 1552 to enable movement of the screws to desired rotational positions to make the necessary club parameter adjustments (e.g., changes to lie angle, loft angle, face angle, etc.). This step is shown in FIG. 15C by the double headed arrows 1520 adjacent the screws 1552. Once the necessary adjustments are complete, the drive shafts 1516A and 1516B are disengaged from the screws 1552 and retracted (e.g., in a telescoping manner, in a rotational manner, etc.), as shown by arrows 1522 in FIG. 15C. Complete disengagement of the adjustment mechanisms 1510A and 1510B from the club head 1550 (or other club component) can automatically trigger the lock switch 1512 to its unlocked or Load/Unload position, as shown in FIG. 15C by arrow 1524. The locking, engagement, adjustment, disengagement, and unlocking processes all may be controlled by processing system 1502, if desired. Alternatively, if desired, the lock switch 1512 can be moved manually, e.g., after an indicator (e.g., audio, visual, etc.) has advised that the adjustment process is complete. Other process steps also can be initiated or activated manually, if desired. Once unlocked, the club head 1550 (or other club component) can be removed from the adjustment station 1500 chamber 1504, as shown in FIG. 15D, and is ready for play with the new settings.

A wide variety of changes to the specific mechanisms, the adjustment steps, the adjustment station, and the like may be made from the specific examples shown in FIGS. 15A through 15D and described above without departing from this invention. The reader should understand that the above description and FIGS. 15A through 15D only provide some examples of these aspects of the invention.

Figure 16A:
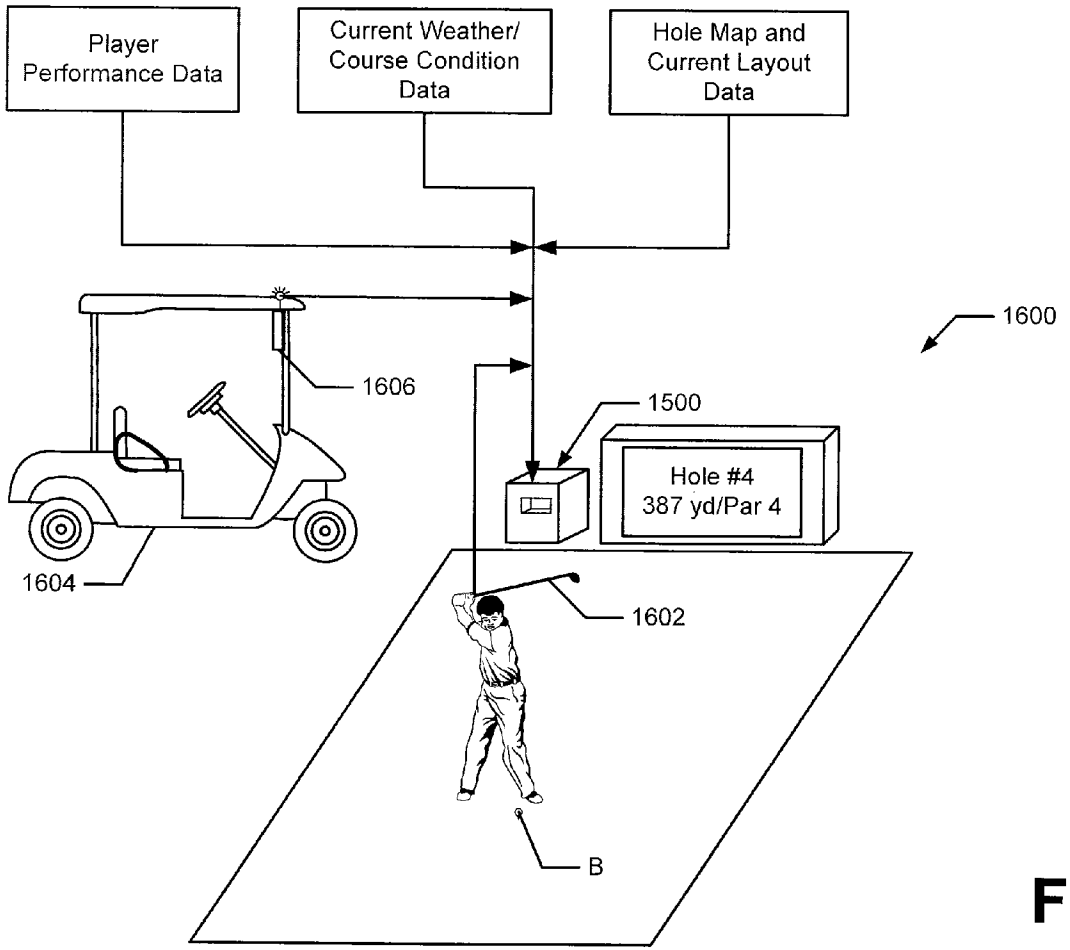
FIGS. 16A and 16B illustrate examples of various systems and environments in which golf club adjustment stations may be used in accordance with at least some aspects of this invention.

In the above description, aspects of this invention have been described primarily for use at a driving range or other ball hitting station, e.g., immediately prior to a round of golf, at a retail or purchase point location, or the like. The invention is not limited to use at these specific locations. As another example, if desired, club adjustment stations 1500 of the types described above in conjunction with FIGS. 15A through 15D (or stations for adjusting other desired club parameters, including lie angle, shaft flexibility, shaft kickpoint, face flexibility, etc.) may be provided at one or more locations on the actual golf course itself. FIG. 16A illustrates one example in which a club adjustment station 1500 is provided at the tee complex 1600 of one of the golf holes (the $4^{th}$ Hole, in this illustrated example) on the golf course being played. Such adjustment stations 1500 could be provided at any desired location(s), such as on the 1st and 10th holes (e.g., at the tees), on every hole (e.g., at the tees), on every other hole, etc.

As shown in FIG. 16A, the adjustment station 1500 may receive input data from a variety of sources (e.g., wirelessly, using any desired communication system and/or transmission protocol), such as hole map or current hole layout data, current weather and/or course condition data, player performance data (optionally including performance data from play of earlier holes on the course), and the like. All of this input data may be very current and up to date as the player plays the hole. Additionally, if desired, the player performance data may include information to indicate how the player is playing on that particular day, e.g., whether player's shots on previous holes within that specific round are going high, low, straight, left, right, fading, drawing, hooking, slicing, etc.; the distance previous shots are traveling (optionally, correlated to the club used for the shot); etc. Data regarding the player's previous performance during the round could be collected, at least in part, by one or more sensors provided within the golf club 1602, on the golf cart 1604, as part of a golf GPS system 1606 (cart mounted or hand held), in the player's footwear or apparel, etc., or such information could be manually entered by the golfer, e.g., via a hand held computing device.

Figure 16B:
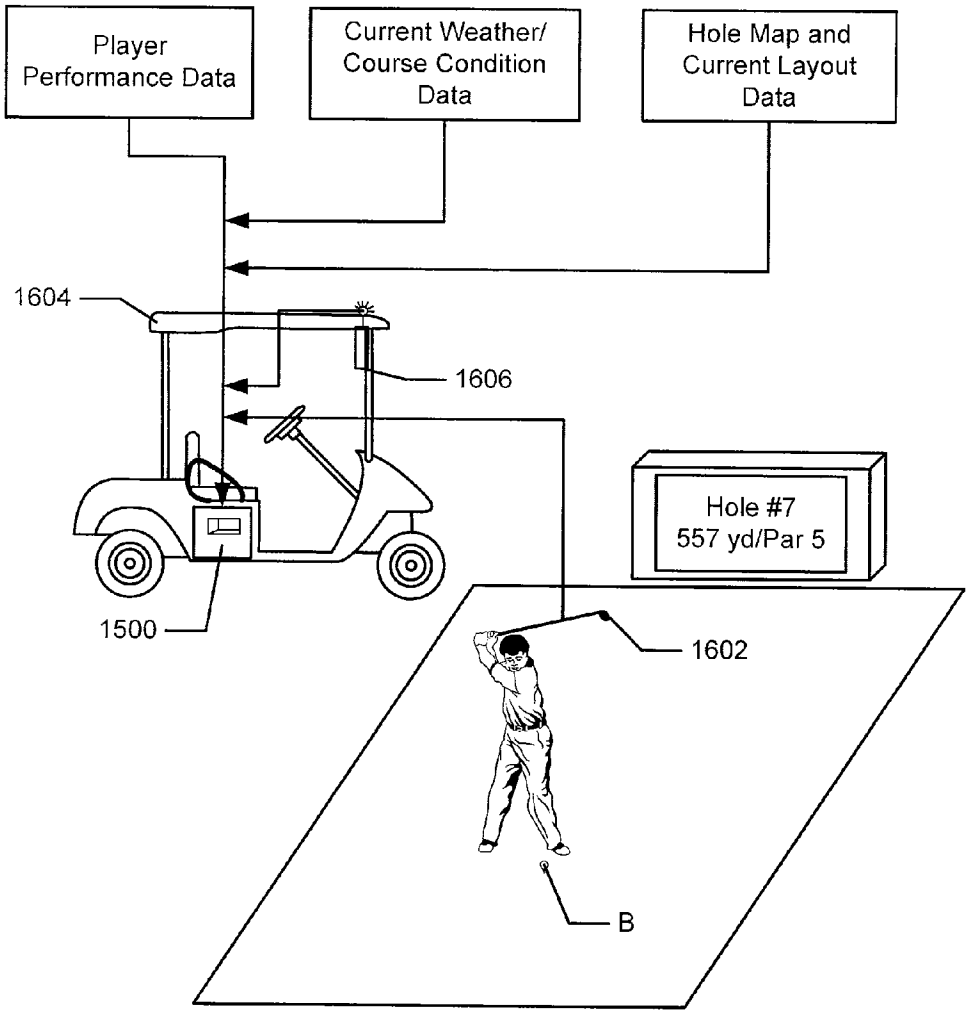

As another example, as illustrated in FIG. 16B, rather than having club adjustment stations 1500 provided at one or more individual tee complexes, the station 1500 could be provided as part of the golf cart 1604 or other equipment used by (or carried by) the golfer during the round. This system has advantages over those described above in conjunction with FIG. 16A in that much of the information and data could be stored locally, which can avoid problems out on the course where trees or other obstructions or the like might make wireless communication and data transfer somewhat unreliable. Also, this mobility feature for the club adjustment station 1500 allows club adjustment changes to be made at any location on the course, not just at the tees (and optionally, with respect to any adjustable club being used by the golfer).

Figure 17A:
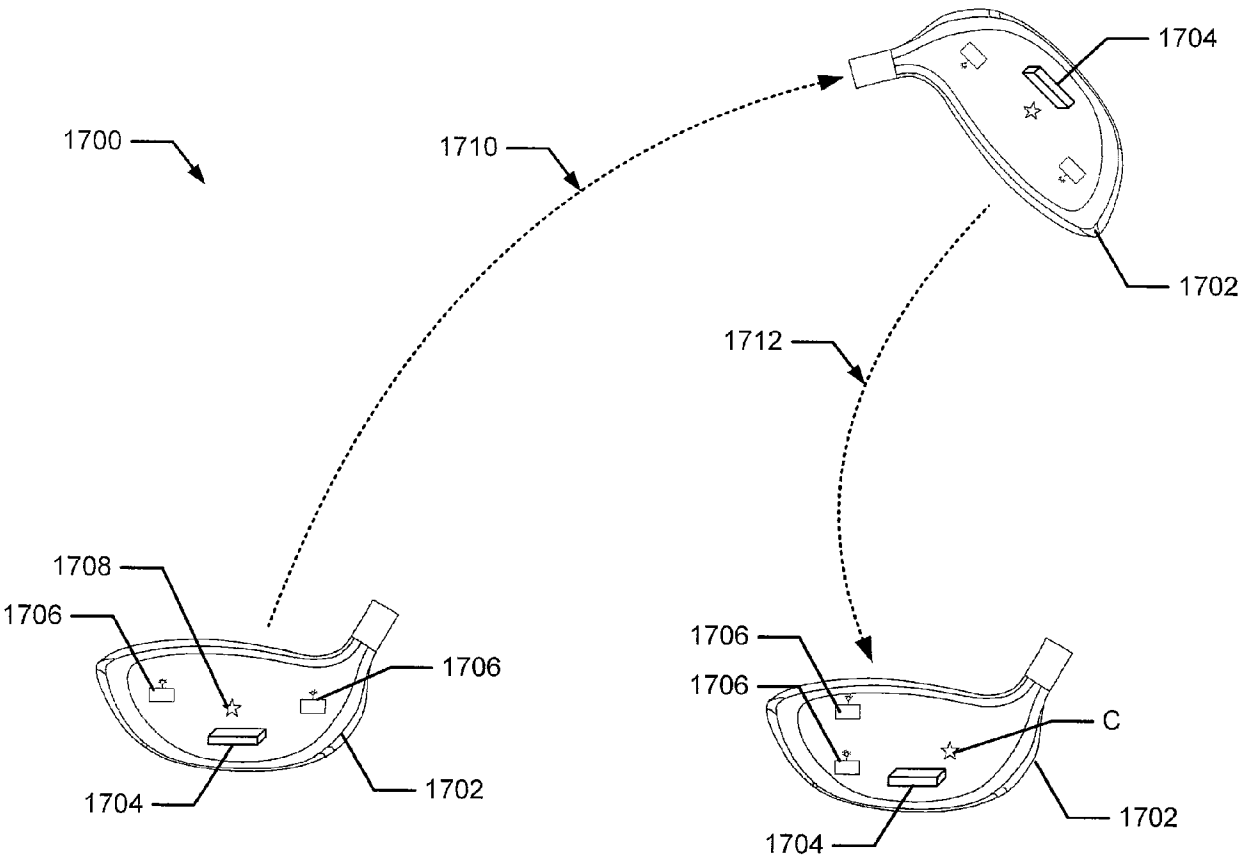
FIGS. 17A and 17B illustrate examples of "on the fly" golf club parameter adjustment systems and methods according to some aspects of this invention.
Figure 17B:
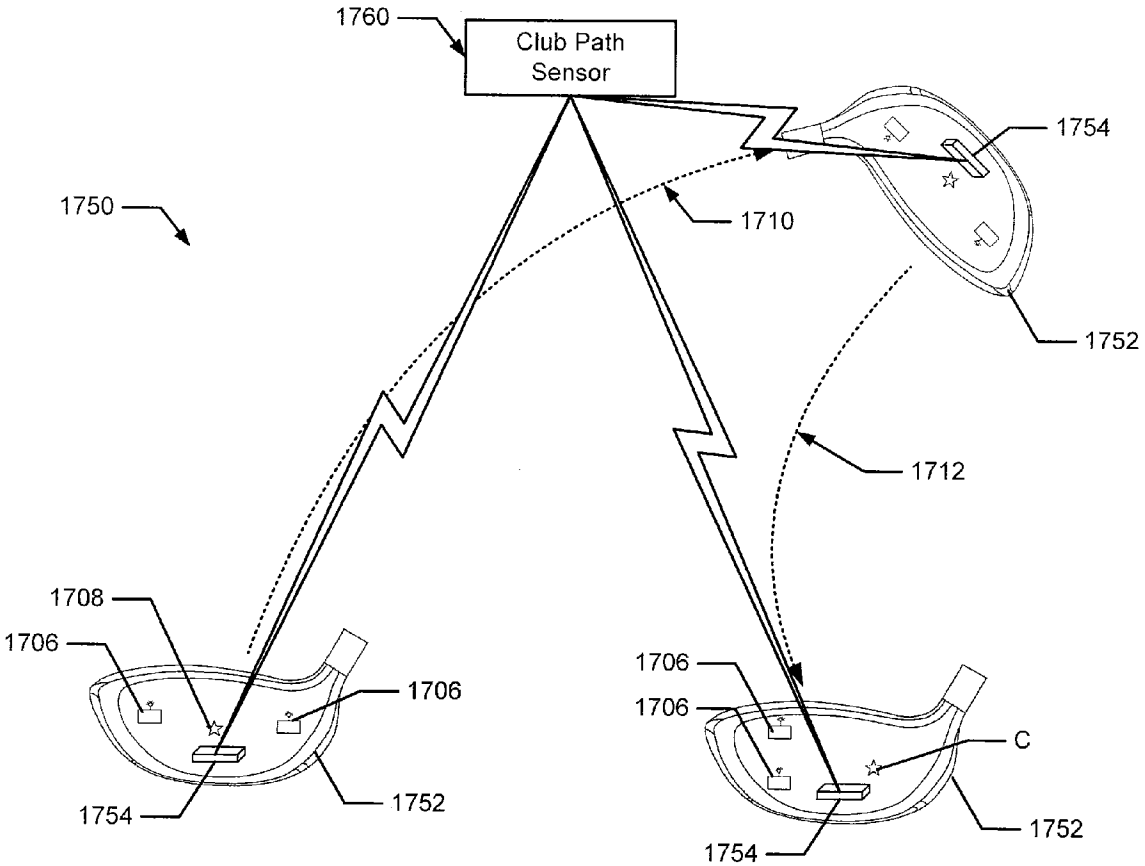

FIGS. 17A and 17B show additional features that may be provided with systems and methods according to at least some additional aspects of this invention. These systems constitute examples of true "on-the-fly" club parameter adjustment systems. While the illustrated example systems 1700 and 1750 of FIGS. 17A and 17B show adjustment of various features on a driver head 1702 and 1752, respectively, one or more features of this aspect of the invention may be applied to any type of club or club head and/or to adjustment of any desired club parameter, including, for example, loft angle, face angle, lie angle, shaft flexibility, shaft kickpoint, face flexibility, weight positioning, etc.

FIG. 17A illustrates an example system 1700 in which one or more club parameters may be adjusted during the course of a swing. The club head 1702 includes one or more sensors 1704 (e.g., one or more accelerometers (e.g., a 3-axis accelerometer), gyrometers, etc.) that are capable of sensing or determining the club head path during a swing. The bottom left side of FIG. 17A shows the club head 1702 at a ball address position. Notably, in this example scenario, two face flexibility support members 1706 (e.g., of the types described and illustrated above in conjunction with FIGS. 13A through 13D) are shown at horizontally separated positions on opposite sides of the ball address location, which in this example also corresponds to an ideal or optimum ball contact position for launch (designated by star 1708 in FIG. 17A). The top of FIG. 17A shows the club head at the top of the backswing (designated by arrow 1710). The swing path of the club head 1702 is tracked by the sensor(s) 1704 throughout the course of the backswing 1710 and the downswing (represented by arrow 1712). As the downswing progresses, a computer processing system in communication with the sensors 1704 determines the predicted position of the club head 1702 with respect to the ball when the club head 1702 returns toward the location of the ball. Alternatively, if desired, the actual position of the ball with respect to the club head 1702 can be sensed, e.g., with sensors provided at the club head 1702, for example, using optical detectors, infrared detectors, radar, ultrasound, etc. These determinations allow a projected ball-to-club face contact position C to be determined (shown by star C in the bottom right of FIG. 17A) during the course of a swing. Once a projected ball-to-club face contact position C is determined, prior to actual contact with the ball, one or more of the face supports 1706 can be moved to positions so as to increase the flexibility of the club head face at the projected location of ball contact C. In the example shown in FIG. 17A, the face supports 1706 move to the toe side of the club head 1702 during the course of the downswing 1712 when the projected contact location C was determined to be at the heel side of the club (to thereby provide more face flexibility in the heel).

System 1700 is not limited to changing face flexibility, but rather, any desired club parameter can be changed in response to club path data or other data without departing from this invention. For example, if sensors in accordance with the invention determine that the club face angle is somewhat open as it approaches ball contact, mechanisms can be activated in the head to attempt to close (square) the face at ball contact (e.g., of the types shown in FIG. 9A through 10B). Such face angle changes also could be initiated in response to detection of an excessively outside-to-inside club path or in response to detection of a "casting" type initial downswing move. As another example, if sensors in accordance with the invention determine that the club face angle is somewhat closed as it approaches ball contact, mechanisms can be activated in the head to attempt to open (square) the face at ball contact (e.g., of the types shown in FIG. 9A through 10B). Shaft stiffness parameters also may be changed to control the extent to which the club face opens or closes as ball contact approaches. In similar manners, club path determinations may be used to make "on-the-fly" type changes to the club's loft angle (e.g., in an effort to improve overall shot distance), lie angle, etc.

FIG. 17B illustrates another example system 1750 in which one or more club parameters may be adjusted during the course of a swing. While the overall system 1750 is similar to that described above in conjunction with FIG. 17A, in this example system 1750, the club head 1752 includes a data input system 1754 that receives club path and/or club adjustment data from an external club path sensor 1760 (e.g., mounted on a golf cart, golf bag, at the tee, etc.) that is capable of sensing the club head path during a swing (e.g., a video device, high speed cameras, etc.). The club path sensor 1760 may either send club path data to the data input system 1754 (which can then determine the necessary adjustments, e.g., to locations of face supports 1706 or other club parameters) or the club path sensor 1760 may send the adjustment data to the data input system 1754. Additionally or alternatively, the data input system 1754 on board the club head 1752 may be provided directly as part of the face supports 1706 (rather than as a separate input device 1754, as shown in FIG. 17B. The data input system 1754 also may be provided on other parts of the club, such as at the shaft or grip.

The system 1750 of FIG. 17B may operate in generally the same or a similar manner to the system 1700 of FIG. 17A, so this description will not be repeated.

As noted above, systems and methods according to aspects of this invention rely on data transmissions and communications between various devices. Any desired types of communications are possible without departing from this invention, including infrared transmissions, Bluetooth transmissions, cellular telephone or other radio communications, hard wired connections, networked connections, etc. Appropriate communications and transmission equipment and/or protocols may be provided and used for each portion of the transmission, and such communications and transmission equipment may be readily selected and configured by those skilled in the art.

CONCLUSION

Of course, many modifications to the adjustable club setting systems and/or methods may be made without departing from the invention. For example, the data collected, its use, and/or its presentation to the users may vary widely without departing from this invention. With respect to the methods, additional steps may be added, various described steps may be omitted, the content of the steps may be changed and/or changed in order, and the like, without departing from the invention. Therefore, while the invention has been described with respect to specific examples including presently preferred modes of carrying out the invention, those skilled in the art will appreciate that there are numerous variations and permutations of the above described structures and methods. Thus, the spirit and scope of the invention should be construed broadly as set forth in the appended claims.

I claim:

1. A golf club, comprising:

a golf club head;

a shaft engaged with the golf club head;

a grip member engaged with the shaft;

a computer processing system engaged with at least one of the golf club head, the shaft, or the grip member, wherein the computer processing system performs at least one function selected from the group consisting of: receiving input data regarding a swing path of the golf club during a swing, receiving input data regarding a first change to an adjustable golf club parameter, generating data regarding the swing path of the golf club during the swing, and generating data regarding the first change to the adjustable golf club parameter, and wherein the computer processing system additionally transmits golf club parameter change information based on the data regarding the swing path or the data regarding the first change; and a golf club parameter adjustment system included with at least one of the golf club head, the shaft, or the grip member, wherein the golf club parameter adjustment system receives the golf club parameter change information from the computer processing system and changes at least a first parameter of the golf club such that the first parameter is at a first setting at a beginning of the swing and at a second setting different from the first setting at a ball strike time during the swing.

2. A golf club according to claim 1, further comprising:

a sensor system engaged with at least one of the golf club head, the shaft, or the grip member, wherein the sensor system produces input data regarding the swing path of the golf club during the swing, and wherein the computer processing system receives the input data from the sensor system and generates the data regarding the first change to the adjustable golf club parameter.

3. A golf club according to claim 2, wherein the sensor system includes an accelerometer.

4. A golf club according to claim 1, wherein the computer processing system further includes an input system for receiving input data regarding the swing path of the golf club during the swing from an external source.

5. A golf club according to claim 1, wherein the computer processing system further includes an input system for receiving input data regarding the first change to the adjustable golf club parameter from an external source.

6. A golf club according to claim 1, wherein the golf club parameter adjustment system includes a first movable weight member, and wherein a position of the first movable weight member is controlled during at least a portion of the swing based on the golf club parameter change information received from the computer processing system.

7. A golf club according to claim 6, wherein the position of the first movable weight member is changed during the swing to move closer to a heel area of the golf club head.

8. A golf club according to claim 6, wherein the position of the first movable weight member is changed during the swing to move closer to a toe area of the golf club head.

9. A golf club according to claim 6, wherein the position of the first movable weight member is changed during the swing to move closer to a rear of the golf club head.

10. A golf club according to claim 6, wherein the position of the first movable weight member is changed during the swing to move closer to a front of the golf club head.

11. A golf club according to claim 1, wherein the golf club parameter adjustment system includes a first movable weight member and a second movable weight member, wherein a position of the first movable weight member is controlled during at least a portion of the swing based on the golf club parameter change information received from the computer processing system, and wherein a position of the second movable weight member is controlled during at least a portion of the swing based on the golf club parameter change information received from the computer processing system.

12. A golf club according to claim 11, wherein relative positioning of the first and second movable weight members is changed during the swing to move the first and second movable weight members closer together.

13. A golf club according to claim 11, wherein relative positioning of the first and second movable weight members is changed during the swing to move the first and second movable weight members farther apart.

14. A golf club according to claim 11, wherein the position of at least one of the first movable weight member and the second movable weight member is changed during the swing to move closer to a toe area of the golf club head.

15. A golf club according to claim 11, wherein the position of at least one of the first movable weight member and the second movable weight member is changed during the swing to move closer to a heel area of the golf club head.

16. A golf club according to claim 11, wherein the position of at least one of the first movable weight member and the second movable weight member is changed during the swing to move closer to a rear of the golf club head.

17. A golf club according to claim 11, wherein the position of at least one of the first movable weight member and the second movable weight member is changed during the swing to move closer to a front of the golf club head.

18. A golf club according to claim 1, wherein the golf club parameter adjustment system includes a first movable face support member for controlling a flexibility of a face of the golf club head, and wherein a position of the first movable face support member is controlled during at least a portion of the swing based on the golf club parameter change information received from the computer processing system.

19. A golf club according to claim 18, wherein the position of the first movable face support member is changed during the swing to allow increased flexibility of a heel portion of the face.

20. A golf club according to claim 18, wherein the position of the first movable face support member is changed during the swing to allow increased flexibility of a toe portion of the face.

21. A golf club according to claim 18, wherein the position of the first movable face support member is changed during the swing to allow increased flexibility of a central portion of the face.

22. A golf club according to claim 18, wherein the position of the first movable face support member is changed during the swing to provide a face flex backstop when a golf club head swing speed exceeds a threshold value.

23. A golf club according to claim 1, wherein the golf club parameter adjustment system includes a first movable face support member and a second movable face support member for controlling a flexibility of a face of the golf club head, wherein a position of the first movable face support member is controlled during at least a portion of the swing based on the golf club parameter change information received from the computer processing system, and wherein a position of the second movable face support member is controlled during at least a portion of the swing based on the golf club parameter change information received from the computer processing system.

24. A golf club according to claim 23, wherein relative positioning of the first movable face support member and the second movable face support member is changed during the swing to allow increased flexibility of a heel portion of the face.

25. A golf club according to claim 23, wherein relative positioning of the first movable face support member and the second movable face support member is changed during the swing to allow increased flexibility of a toe portion of the face.

26. A golf club according to claim 23, wherein relative positioning of the first movable face support member and the second movable face support member is changed during the swing to allow increased flexibility of a central portion of the face.

27. A golf club according to claim 23, wherein the position of at least one of the first movable face support member and the second movable face support member is changed during the swing to provide a face flex backstop when a golf club head swing speed exceeds a threshold value.

28. A golf club according to claim 1, wherein the golf club parameter adjustment system includes a face angle adjustment member, and wherein a setting of the face angle adjustment member is controlled during the swing to change a face angle of the golf club based on the golf club parameter change information received from the computer processing system.

29. A golf club according to claim 28, wherein the setting of the face angle adjustment member is changed during the swing to close the face angle of the golf club head.

30. A golf club according to claim 28, wherein the setting of the face angle adjustment member is changed during the swing to open the face angle of the golf club head.

31. A golf club according to claim 1, wherein the golf club parameter adjustment system includes a loft angle adjustment member, and wherein a setting of the loft angle adjustment member is controlled during the swing to change a loft angle of the golf club based on the golf club parameter change information received from the computer processing system.

32. A golf club according to claim 31, wherein the setting of the loft angle adjustment member is changed during the swing to increase the loft angle of the golf club head.

33. A golf club according to claim 31, wherein the setting of the loft angle adjustment member is changed during the swing to decrease the loft angle of the golf club head.

34. A golf club according to claim 1, wherein the golf club parameter adjustment system includes a shaft flexibility adjustment member, and wherein a setting of the shaft flexibility adjustment member is controlled during the swing to change a shaft flexibility of the golf club based on the golf club parameter change information received from the computer processing system.

35. A golf club according to claim 34, wherein the setting of the shaft flexibility adjustment member is changed during the swing to increase flexibility of the shaft during the swing.

36. A golf club according to claim 34, wherein the setting of the shaft flexibility adjustment member is changed during the swing to decrease flexibility of the shaft during the swing.

37. A golf club according to claim 1, wherein the golf club parameter adjustment system includes a shaft kickpoint adjustment member, and wherein a setting of the shaft kickpoint adjustment member is controlled during the swing to change a kickpoint location of the shaft of the golf club based on the golf club parameter change information received from the computer processing system.

38. A golf club according to claim 37, wherein the setting of the shaft kickpoint adjustment member is changed during the swing to move the shaft kickpoint location closer to the golf club head.

39. A golf club according to claim 37, wherein the setting of the shaft kickpoint adjustment member is changed during the swing to move the shaft kickpoint location closer to the grip member.

* * * * *